US006119425A

United States Patent [19]

Shimonohara

[11] Patent Number: 6,119,425

[45] **Date of Patent: *Sep. 19, 2000**

[54] STRUCTURE MEMBERS AND A METHOD OF JOINTING THE SAME

[76] Inventor: Takeshige Shimonohara, 8-10 Nishiki-cho 5-chome, Warabi, Saitama-ken 335, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/757,937

[22] Filed: Nov. 27, 1996

[30] Foreign Application Priority Data

Dec. 1, 1995 [JP] Japan ..... 7-314393

[51] Int. Cl.[7] ..... E04B 1/38

[52] U.S. Cl. ..... 52/439; 52/721.4; 52/723.1; 52/724.5; 52/726.2; 52/726.3; 52/736.3; 52/737.4; 52/742.15; 403/269; 403/292; 264/267; 264/274

[58] Field of Search ..... 52/721.1–721.3, 52/722.1, 721.4, 723.1, 724.5, 726.1, 726.2, 726.3, 736.3, 737.4, 439, 742.14, 472.15; 411/427, 904; 405/252.1, 256, 257; 403/307, 299; 138/122, 173, 175

[56] References Cited

U.S. PATENT DOCUMENTS

| | | | |
|---|---|---|---|
| Re. 23,074 | 1/1949 | Henderson . | |
| 720,578 | 2/1903 | Greenfield | 285/390 X |
| 838,060 | 12/1906 | Stieler | 52/722.1 |
| 1,410,453 | 3/1922 | Butcher . | |
| 1,900,524 | 3/1933 | Schoeder et al. | 405/257 X |
| 2,828,162 | 3/1958 | Johnson et al. . | |
| 2,836,806 | 5/1958 | Stroup . | |
| 3,048,433 | 8/1962 | Doetsch . | |
| 3,424,479 | 1/1969 | Ditson et al. | 403/307 X |
| 3,545,214 | 12/1970 | Grazel . | |
| 3,643,702 | 2/1972 | Kauder | 138/173 X |
| 3,933,182 | 1/1976 | Costes | 138/175 X |
| 4,004,392 | 1/1977 | Shepard et al. | 264/263 X |
| 4,006,600 | 2/1977 | Guild . | |
| 4,630,959 | 12/1986 | Glaser | 264/263 X |
| 4,672,782 | 6/1987 | Richter et al. | 52/722.1 X |
| 4,783,940 | 11/1988 | Sato et al. . | |
| 4,864,797 | 9/1989 | Sato et al. . | |
| 5,067,842 | 11/1991 | Ponting | 156/304.2 X |
| 5,611,374 | 3/1997 | Blin et al. | 138/122 X |

FOREIGN PATENT DOCUMENTS

| | | |
|---|---|---|
| 0058851A1 | 9/1982 | European Pat. Off. . |
| 0637694A1 | 2/1995 | European Pat. Off. . |
| 607 265 | 3/1926 | France . |
| 560 566 | 4/1944 | United Kingdom . |

*Primary Examiner*—Robert Canfield
*Attorney, Agent, or Firm*—Flynn, Thiel, Boutell & Tanis, P.C.

[57] ABSTRACT

There are provided structure members by which ordinary workers other than technical workers can easily joint beams and beams, beams and pillars respectively made of concrete and also can construct buildings which can be extended. There are also provided methods of jointing the structure members. The structure member comprises a hollow tube made of concrete or a material similar thereto. Two or more structure members arch having irregular portions on an inner surface thereof are butt-joined with each other, then a filler is introduced into the hollow portion of each structure member to be solidified so as to joint the structure members. Reinforcing members etc. are put into the hollow portions of the structure members, or steel frames and bag bodies, etc. are fixed by a jointing frame and a filler is introduced therein. It is also possible to joint two or more structure members by way of a jointing member.

20 Claims, 35 Drawing Sheets

STRUCTURE MEMBERS AND A METHOD OF JOINTING THE SAME

BACKGROUND OF THE INVENTION

1. Field of the Invention

The present invention relates to structure members constituting pillars and beams of buildings, more particularly to a technical field for jointing structure members made of concrete and a material similar to concrete. The structure members are used for ordinary building, bridges, sand guard structures, piles, utility-line poles, etc.

2. Prior Art

The structures in the fields of earth working and building are generally made mainly of materials of timbers, reinforced concrete and steel frames, and which are however not a little resorting to manual working in the site thereof. Particularly, jointing parts between beams and beams, beams and pillars are complex in a construction thereof, and stress is applied much in such jointing parts, and which leads to the manual working if they are finished with sufficient quality. Among them, in case of the structure members concreting in the site, the manual operation and workers skilled in the art technical workers are required when the jointing parts are. However, there are many buildings which are roughly constructed owing to the labor shortage, high aging of the technical workers, and further a low-cost consciousness. On the other hand, as is reported in Hanshin (Osaka, Kobe and neighborhood) which is the location of the great earthquake which occurred on January of 1995, 30 to 40% of the buildings in Kobe city which were built a decade ago have collapsed owing to the construction error although such buildings were constructed by the technical workers. Meanwhile, it is evident that the buildings which are built recently are deteriorated in quality since it is built by the technical workers whose level are lower than those of the decade ago.

In addition to the lowering of the quality, the design of the building per se has been simplified recently. Accordingly, sonorous buildings like the medieval European buildings are not found recently, which makes a city space bleak. If the design of the construction is not excellent, people are neither relaxed nor feel at ease, which lowers the level of culture, resulting in devastation of cities.

SUMMARY OF THE INVENTION

It is an object of the present invention to provide structure members enabling even ordinary workers except technical workers to joint beams and beams and beams and pillars with ease, and capable of constructing sonorous buildings, and it is another object of the present invention to provide a method of jointing the structure members.

To achieve the above objects, the structure member of the present invention are usable to pillars or beams and formed of a hollow tube made of concrete or a material similar to concrete, wherein the hollow tube has irregular portions on an inner surface thereof. The irregular portion on the inner surface may have a helical shape or an inner formwork may be embedded in the inner surface. Further, the hollow tube may have an attachment portion to which an attachment is fixed or may have an aesthetic irregular portion respectively at an outside thereof. Still further, the structure member may comprise a plurality of hollow tubes which are bundled and integrated with one another, or the hollow tube having a notch at a part or an entire thereof. A reinforcing plate may be attached to the inner surface of the hollow tube. Further, a decorative member or a reinforcing member may be attached to a part or an entire surface of the structure member.

The method of jointing structure members of the present invention thus constructed as set forth above comprises the steps of butt-jointing ends of two or more structure members, then introducing a filler into the structure members so as to be solidified. Further the method may comprise the steps of attaching cover members so as to be fixedly attached to portions adjacent to ends of the structure members which are to be jointed, butt-jointing the ends of two or more structure members having respectively cover members attached thereto, then introducing a filler into a space partitioned by the cover members so as to be solidified. In the latter method, it is preferable to use the cover member having an elastic body at the periphery thereof.

Another method of jointing structure members of the present invention thus constructed as set forth above comprises the steps of attaching a bag body to one of the structure members at a portion adjacent to an end thereof to be jointed with an end of another structure member, butt-jointing the end of the one structure member with the end of the another structure, then introducing a filler into the bag body so as to be expanded, so that both structure members are jointed with one another. It is preferable as the provision of the bag body that the bag body is fixed to another end of a reinforcing member or the cover member, or the bag body may be restrained from being extended by way of the cover member, the reinforcing member or a restriction member so as to stop the end of the bag body at a given position. Further, a jointing frame may be provided at another end of the bag body. Still further, when the jointing member is jointed with the structure members, the structure members are butt-joined with the jointing member, then the filler is filled utilizing any of the above mentioned methods.

PREFERRED EMBODIMENT OF THE INVENTION

Figure 1:
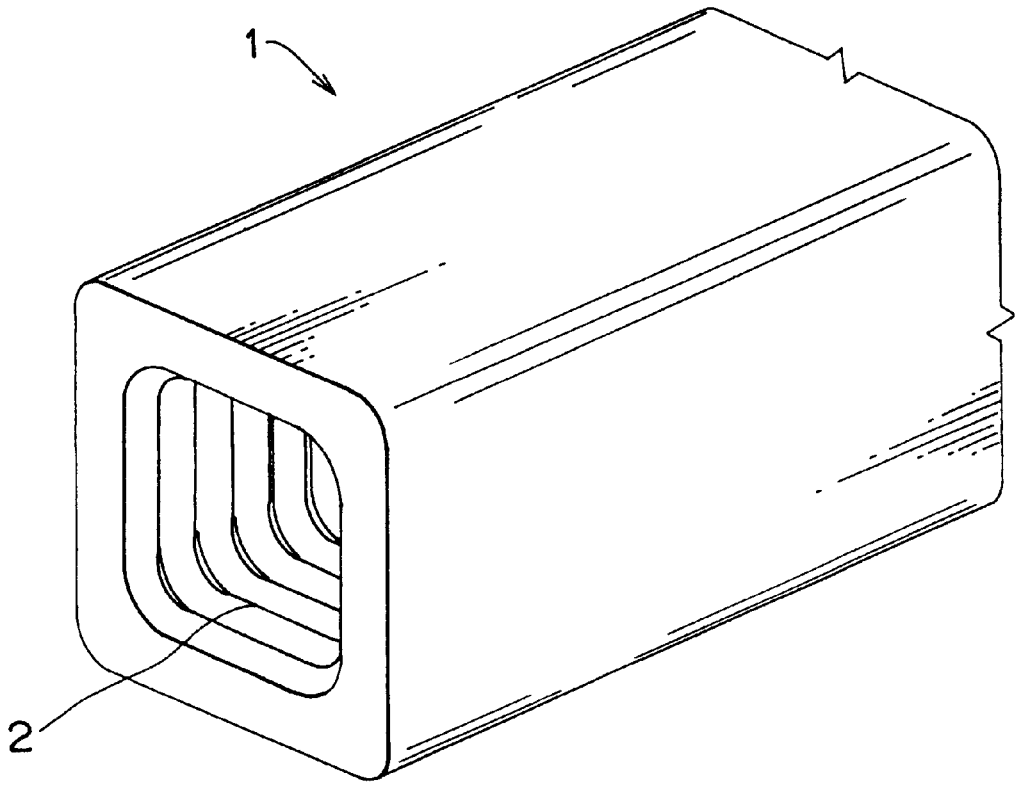
FIG. 1 is a perspective view of a structure member according to a first embodiment of the invention.

FIG. 1 is a perspective view showing an example of a structure member 1 according to a first embodiment of the invention. The structure member is formed of a hollow tube manufactured by concrete or a similar material (ceramic, etc.) and has a plurality of concave and convex portions, i.e., pits and projections (hereinafter referred to as irregular portions) 2 as shown in FIG. 1. The structure member 1 is manufactured as follows in a factory. That is, an inner formwork 3 made of extendible rubber is positioned inside an outer formwork, and the inner formwork 3 has an air hole 3*a* through which air is introduced to be in an expandable state, and the outer formwork having a surface shape corresponding to that of the structure member 1 is placed outside the inner formwork 3 at given intervals, then concrete is introduced into a space between the inner and outer formworks, successively air is extracted from the air hole 3*a* after concrete is hardened, and at the same time the outer formwork is removed. Accordingly, it is possible to manufacture the structure member 1 having the irregular portions 2 corresponding to pleats 3*h* of the inner formwork 3. It is preferable to add a reinforcing rod, nonferrous metals, organic or inorganic fiber (e.g. fibers such as nylon, aramid, glass, carbon) to concrete when concrete is introduced into the space between the inner and outer formworks, thereby reinforcing the structure member 1. It is preferable to form aesthetic irregular portions on the external surface of the structure member 1 depending on uses thereof.

Figure 2:
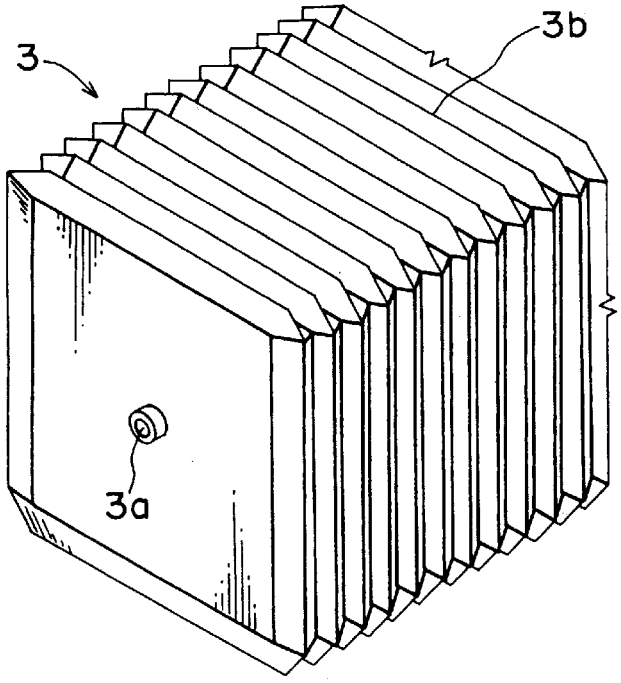
FIG. 2 is a perspective view showing an example of an inner formwork to be used when the structure member in FIG. 1 is manufactured.
Figure 3:
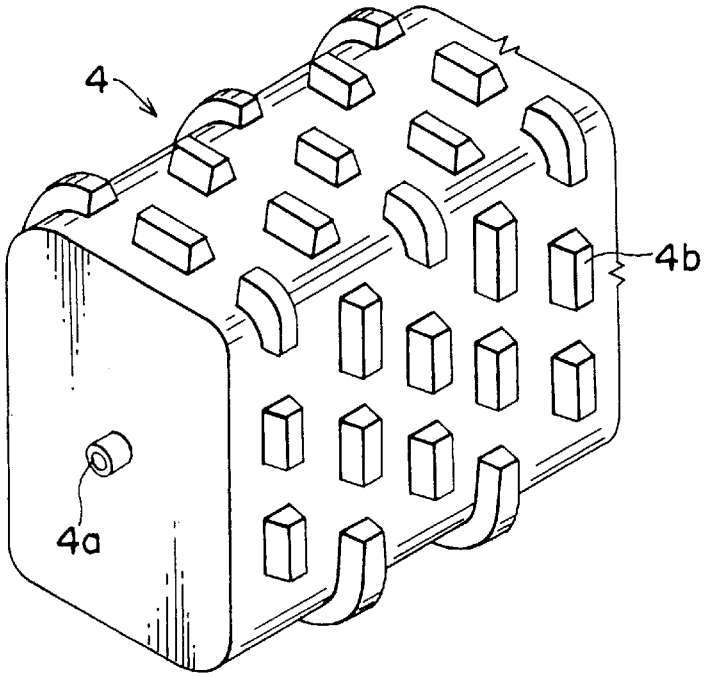
FIG. 3 is perspective view showing another example of an inner formwork.

If an inner formwork 4 made of extendible rubber shown in FIG. 3 is used, it is possible to manufacture the structure member 1 having discontinuous irregular portions at the inner surface thereof corresponding to irregular portions 4*b* of the inner formwork 4. 4*a* is an air hole which is the same as the air hole 3*a* in FIG. 2.

Figure 4:
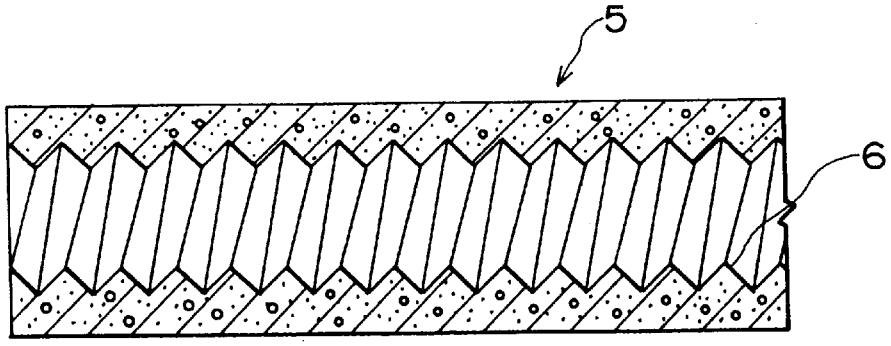
FIG. 4 is a cross-sectional view of a structure member according to a first modification of the first embodiment of the invention.

FIG. 4 is a cross-sectional view of a structure member 5 according to a first modification of the first embodiment in which helical irregular portions 6 are formed at an inner surface of a hollow tube. This structure member 5 is manufactured in the following method in a factory. That is, the method comprises steps of providing an outer formwork having the surface shape corresponding to that of the structure member 5, disposing helical pipes inside the structure member 5 at given intervals, introducing concrete into a space between the helical pipe and the outer formwork, turning and extracting the helical pipe at an appropriate time before concrete is hardened.

Figure 5:
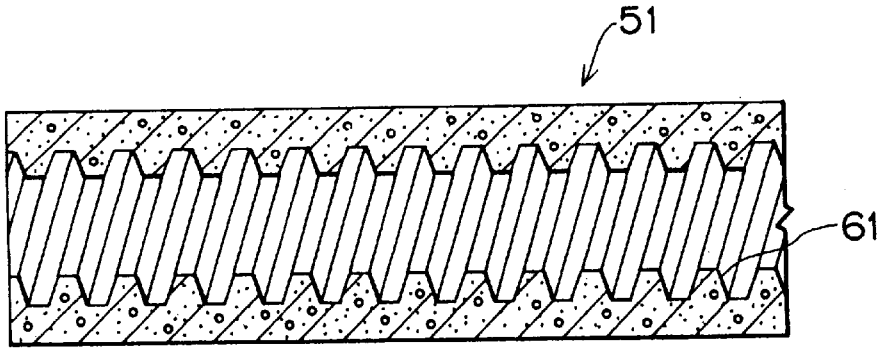
FIG. 5 is a cross-sectional view of a structure member according to a second modification of the first embodiment.
Figure 6:
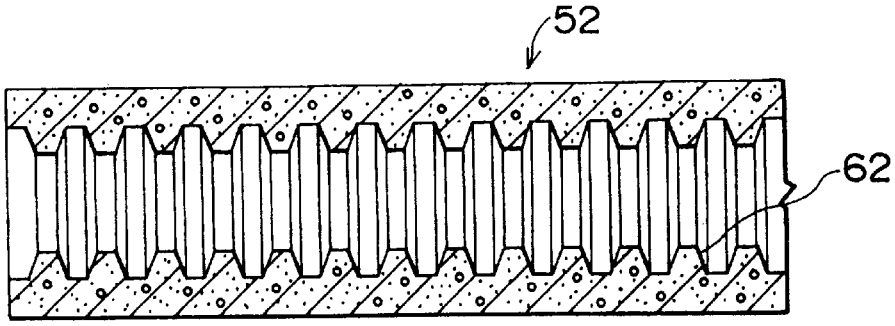
FIG. 6 is a cross-sectional view of a structure member according to a third modification of the first embodiment.
Figure 7:
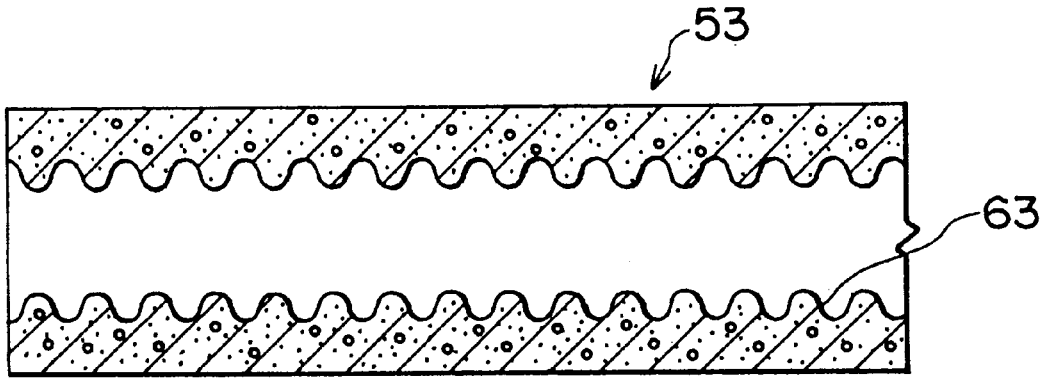
FIG. 7 is a cross-sectional view of a structure member according to a fourth modification of the first embodiment.

The irregular portions provided on the inner surface of the structure member can be arbitrarily shaped using an inner formwork having an appropriate shape. Modifications of such structure member are illustrated in FIGS. 5 through 7. In a structure member 51 shown in FIG. 5, irregular portions 61 are formed of continuous trapezoidal helical screw grooves, while in a structure member 52 shown in FIG. 6, irregular portions 62 are formed of discontinuous trapezoidal grooves. Irregular portions 63 of a structure member 53 shown in FIG. 7 are formed of a combination of semicircular grooves and projections in cross sections corresponding to an outer shape of bellows.

It is possible to manufacture structure members of the invention using an inner formwork which is extendible in a mechanical manner and has irregular portions at the outside thereof in addition to the inner formwork made of rubber set forth above. Alternatively, it is possible to manufacture the structure members by using an inner formwork which can be burnt or corroded, and removing the inner formwork after concrete is hardened. In case of necessity, the inner formwork is embedded and the inner surface thereof can be utilized as the irregular portions.

Figure 8:
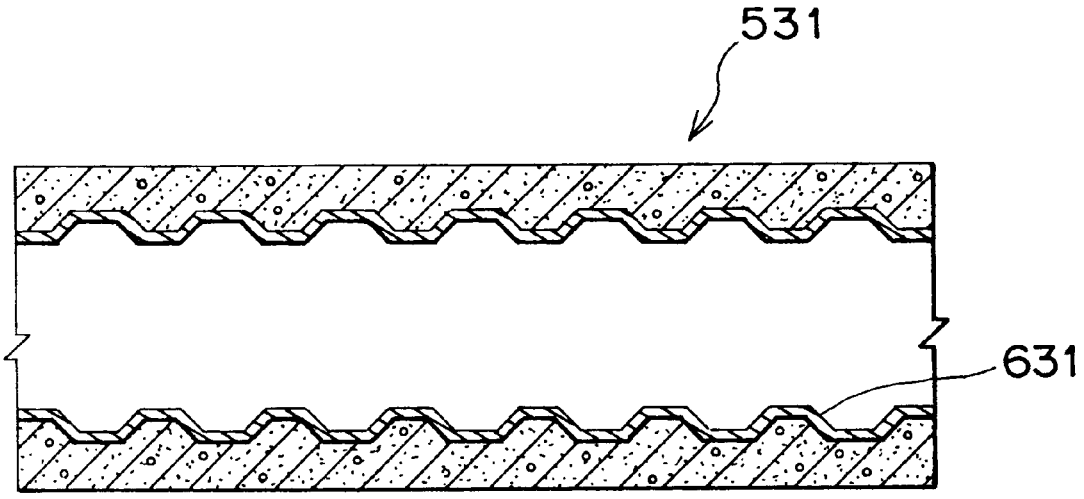
FIG. 8 is a cross-sectional view of a structure member according to a second embodiment of the invention in which an inner formwork is embedded.

FIG. 8 shows a structure member 531 according to a second embodiment of the invention including an inner formwork 631 having trapezoidal irregular portions embedded in the inner surface of a hollow tube. The shape of the inner formwork is not limited to that shown in FIG. 8 but it may be corrugated like irregular portions as shown in FIGS. 4 through 7. The inner formwork may include irregular portions 4*b* as shown in FIG. 3 depending on the uses of the structure member. In this case, there is one method of forming the irregular portions by permitting an irregular member provided outside the inner formwork to be corrugated, and another method of forming the irregular portions by pressing a hollow frame so as to permit the hollow frame to be corrugated. As the inner formwork or the irregular member, iron, nonferrous metals, resins, cement, cellulose, ceramics can be used, or organic or inorganic fibers such as carbon, glass and nylon may be used when they are formed into a plate shape or they are mixed with cement. Strength of the structure member is enhanced when a high strength member such as iron is used as the inner formwork.

Figure 9:
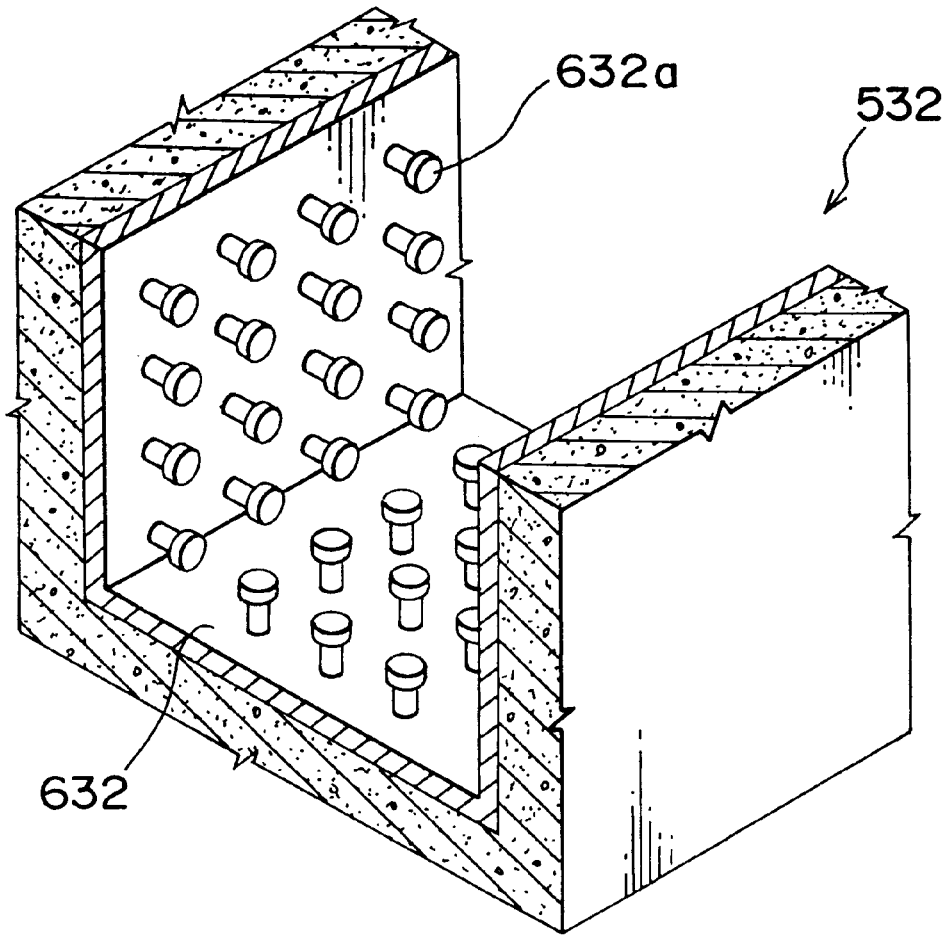
FIG. 9 is a cross-sectional perspective view of a structure member according to a first modification of the second embodiment of the invention in which an inner formwork is embedded.

A structure member according to a modification having the inner formwork embedded therein is illustrated in FIG. 9. FIG. 9 is a cross-sectional perspective view showing the structure member in a cutting state from which the shape of the embedded inner formwork is understood. This structure member 532 has an inner formwork 632 which includes a plurality of projecting members 632*a* fixed to the inside thereof and which is embedded in the inner surface of the hollow tube. The projection members 632*a* may be rod-shaped and may have tip ends each having appropriate shape. Materials of the projection members 632*a* may be the same as or different from those of the inner formwork 632. The projecting members may be directly fixed to the inner surface of the hollow tube depending on the uses of the structure member without using the inner formwork.

Figure 10:
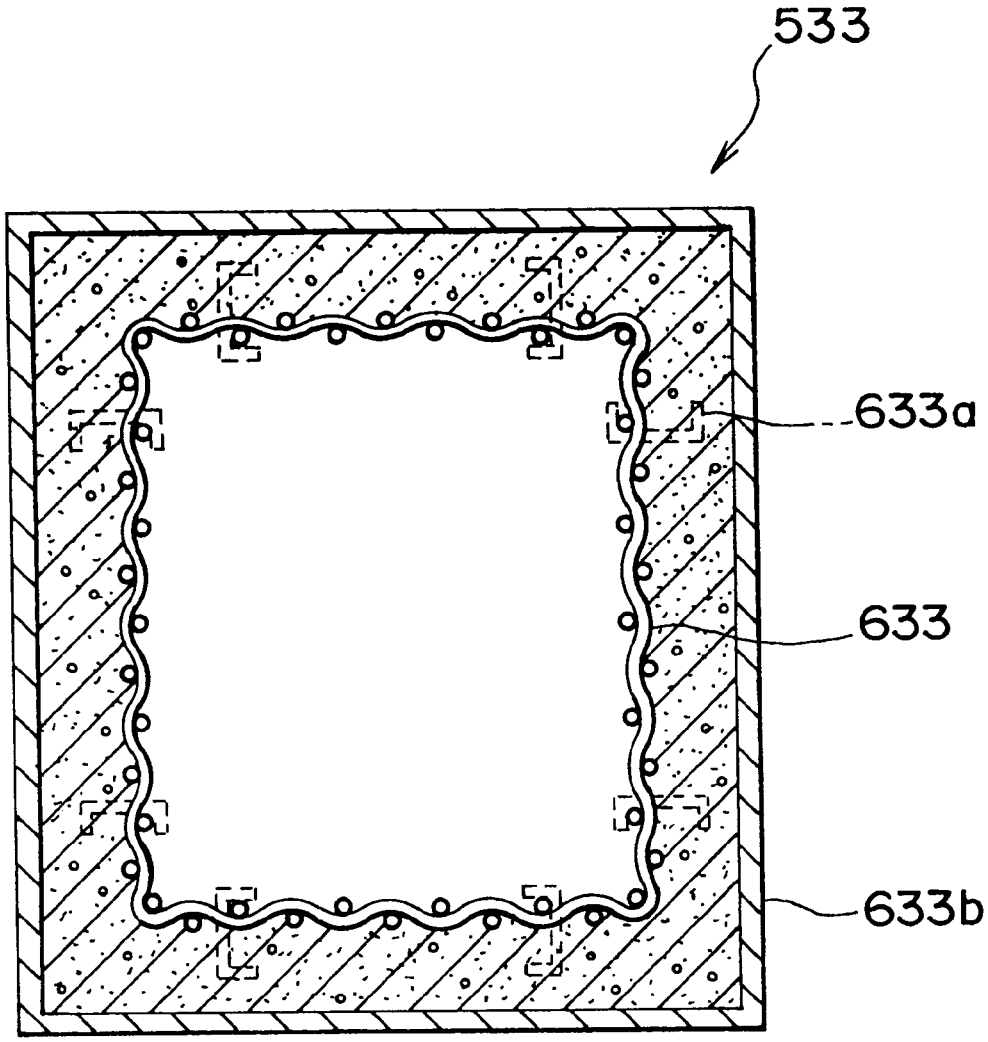
FIG. 10 is a cross-sectional view of a structure member according to a second modification of the second embodiment of the invention in which an inner formwork and a surface member are embedded.

A structure member 533 according to a second modification having an inner formwork 633 which is embedded therein will be now described with reference to FIG. 10. The inner formwork 633 embedded in the structure member 533 is formed by braiding vertical rods and horizontal rods in square cylinders, and anchors 633*a* are provided at appropriate positions so that the inner formwork 633 is fixed to the hollow tube with an excellent condition. The shapes of the vertical and horizontal rods are arbitrary and materials thereof are the same as those of the inner formwork. Decorative members such as tiles or surface members 633*b* as reinforcing members of the structure member may be attached to the front surface of the structure member. The surface member 633*b* may be made of the same material as the inner formwork 633, and it may be bonded partially or wholly on the surface of the inner formwork 633, or may be utilized as an outer formwork or embedded into the inner formwork 633. Such surface members can be utilized for the structure members as shown in FIGS. 1 through 9. The inner formworks shown in FIGS. 9 and 10 may be corrugated or helically shaped.

Figure 11:
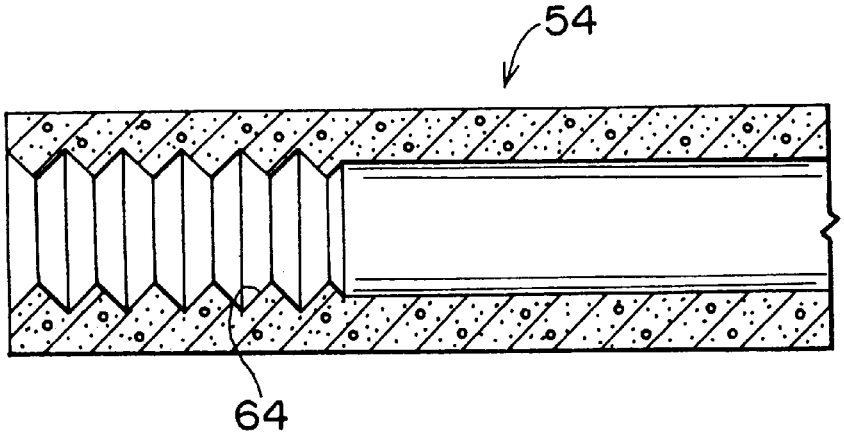
FIG. 11 is a cross-sectional view of a structure member according to a third embodiment of the invention.

The irregular portions of the structure members may be formed on the entire of the hollow tube, or irregular portions 64 may be formed on a portion adjacent to an end portion forming a jointing part like a structure member 54 as shown in FIG. 11 showing a third embodiment of the invention. A structure member having irregular portions provided on the entire surface thereof may be used while it is cut in an appropriate length.

The structure members of the invention may be formed to have an attached portion such as a groove to which an attachment such as a wall member, a door, a sash is attached when they are manufactured in a factory.

Figure 12:
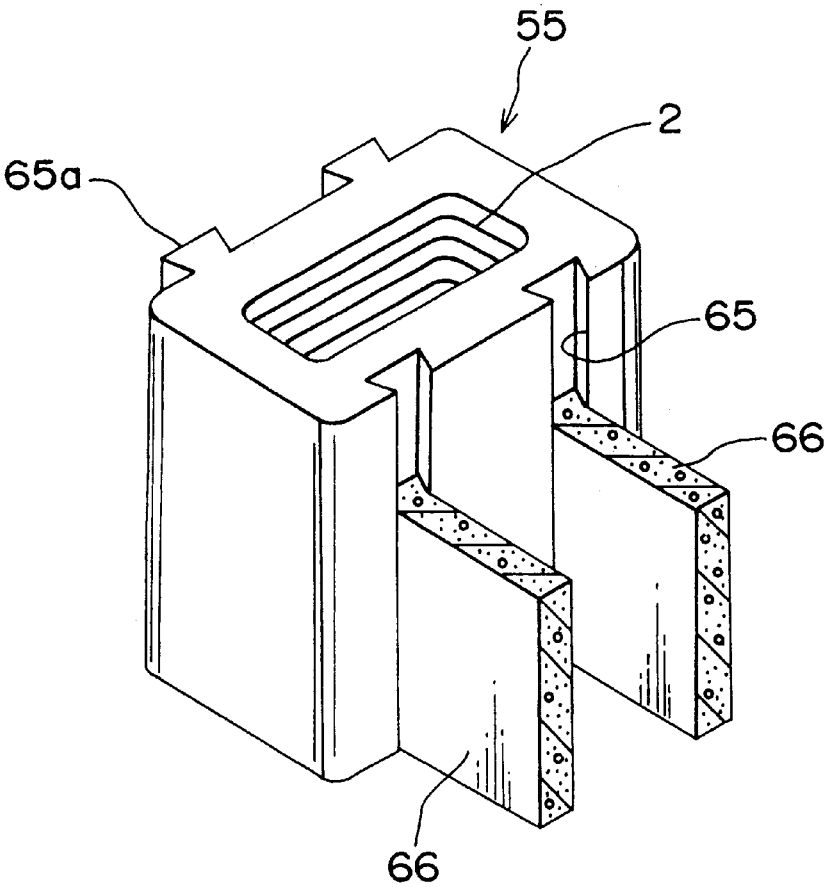
FIG. 12 is a perspective view of a structure member according to a fourth embodiment of the invention wherein the structure member has an attachment member which is attached to an outside thereof.

For example, in a structure member 55 according to a fourth embodiment as illustrated in FIG. 12, one or more than two dovetails are provided as the attachment portion at the external surface thereof in which a panel 66 can be engaged. Projections 65*a* or tenons are provided at the side opposite to the dovetails 65. It is possible to provide appropriate irregular portions on the surface of the structure member, in a vertical or lateral direction (not shown), if need be. Further, it is possible to permit the structure member to have various external shapes on the external surface of the structure member such as a sonorous shape like sculptures or patterns.

Figure 13:
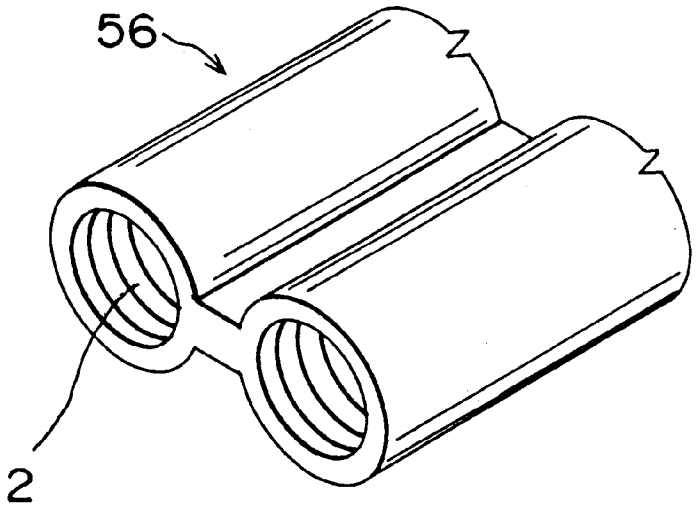
FIG. 13 is a perspective view of a structure member according to a fifth embodiment of the invention wherein the structure member comprises a plurality of bundled hollow tubes.
Figure 14:
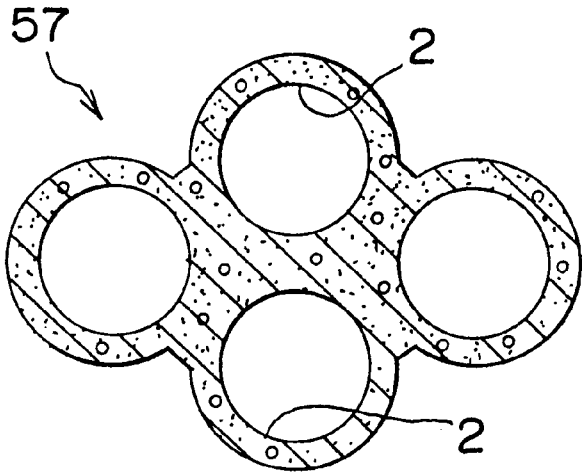
FIG. 14 is a cross-sectional view showing another example of a structure member having a plurality of bundled hollow tubes.
Figure 15:
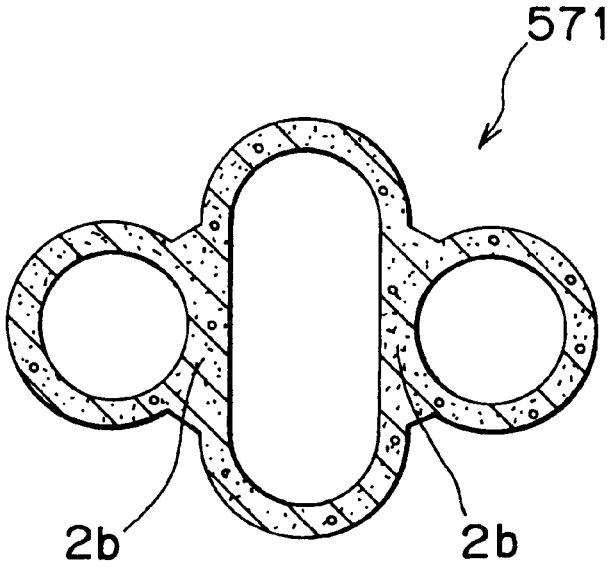
FIG. 15 is a cross-sectional view showing a modification of the structure member shown in FIG. 14.
Figure 16:
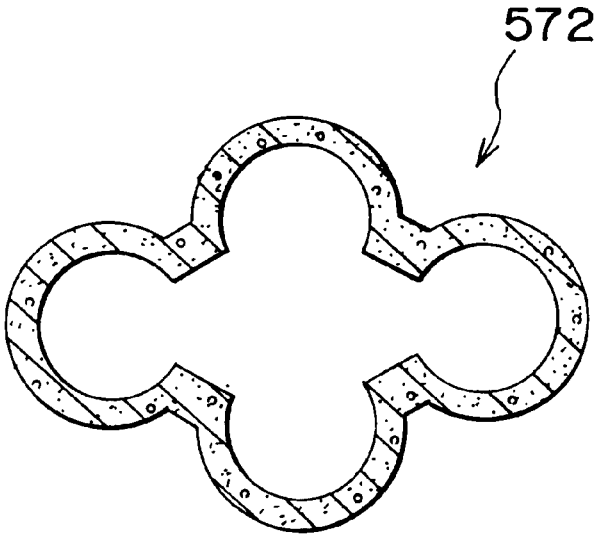
FIG. 16 is a cross-sectional view showing another modification of the structure member shown in FIG. 15.

FIGS. 13 and 14 show structure members 56 and 57 according to a fifth embodiment and another example, wherein structure members 56 and 57 may utilize a plurality of hollow tubes which are bundled to be integrated with each other. In the modification thereof, structure members may have cross-sectional shapes as shown in FIGS. 15 and 16. A structure member 571 shown in FIG. 15 has a shape removing an intermediate wall 2*a* in the structure member 57 in FIG. 14. A structure member 572 shown in FIG. 16 has a shape removing intermediate walls 2*b* in the structure member 571 in FIG. 15. In the structure members of the types shown in FIGS. 13 through 16, the irregular portions 2 are not necessarily provided on the entire inner surface thereof but hollow portions having no irregular portion may be provided depending on the uses thereof. Further, the structure members may have a part of hollow portion which is filled with concrete in a factory instead of having an actual hollow part.

The structure members comprising the hollow tube are not limited to hollow shaped ones which are completely closed at portions other than both ends thereof.

Figure 17A:
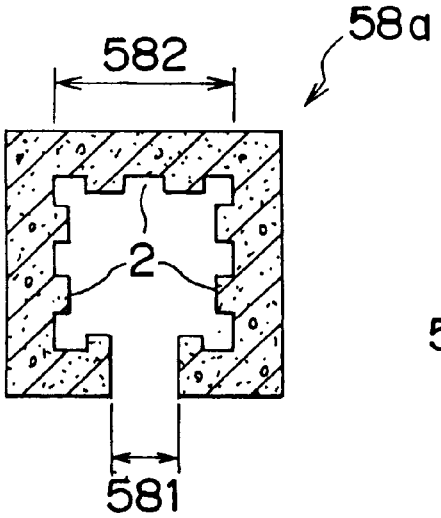
FIGS. 17(A) through (C) are cross-sectional views each showing a structure member according to a sixth embodiment.
Figure 17C:
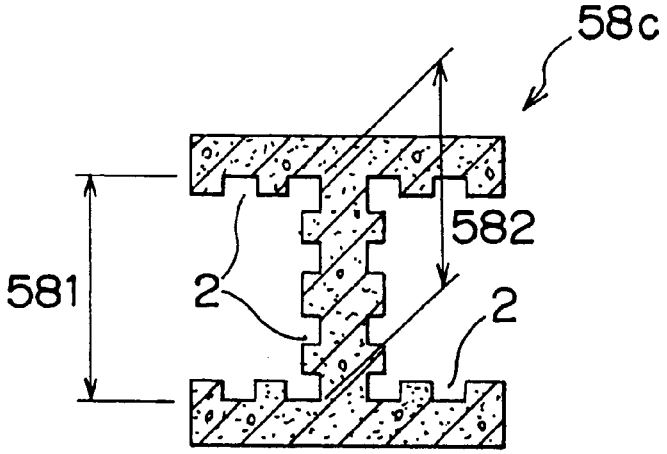
Figure 17B:
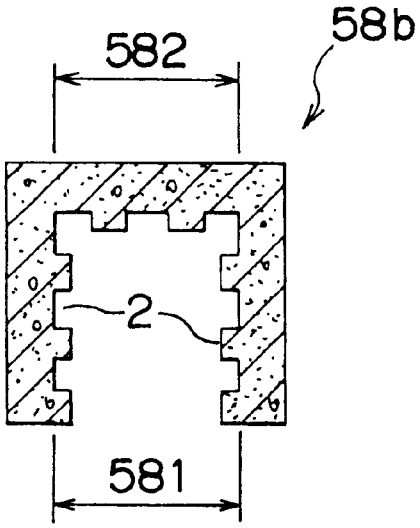

FIGS. 17(A) through (C) showing a sixth embodiment of the invention, there are structure members 58*a*, 58*b*, 58*c* each having a cut portion 581 formed at one or more than two positions along a part or entire length of one or more sides thereof. A width of the cut portion 581 and a size of an inner hollow width 582 are determined depending on uses of the structure members and shapes of the irregular portions 2. It is preferable that the width of the cut portion 581 is smaller than the size of the hollow width 582 so as to assure the jointing condition between the adjoining structure members.

Figure 18:
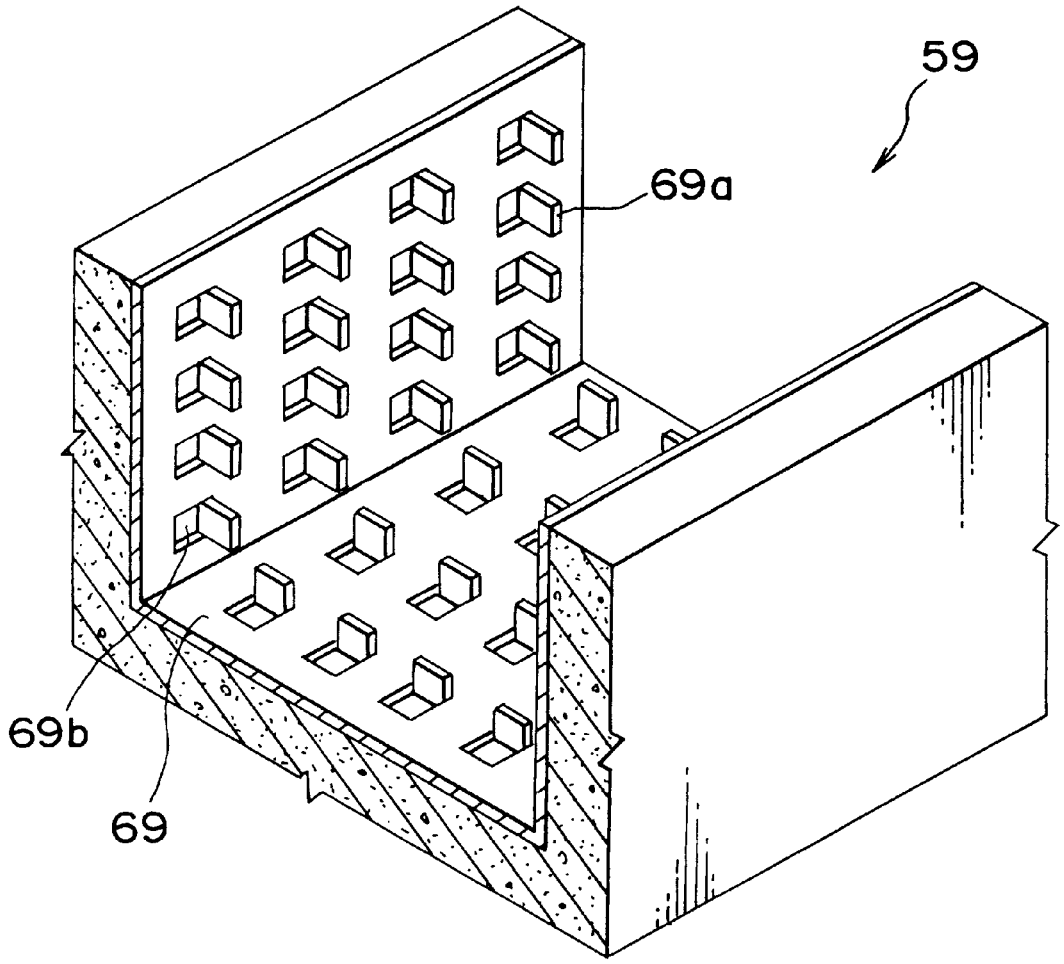
FIG. 18 is a cross-sectional view of a structure member according to a seventh embodiment.

A structure member according to a seventh embodiment will be now described with reference to FIG. 18. A structure member 59 is U-shaped, and has a corresponding inner formwork 69 fixed to the inner surface thereof. The inner formwork 69 is embedded in the structure member 59 when concrete is introduced. Projecting portions 69*a* are formed on the inner formwork 69 by punching. Hollows 69*b* bored by punching the inner formwork may be closed by appropriate means, if need be, since concrete flows out depending on sizes of the holes 69*a*. The inner formwork forming the projecting portions by punching can be used for the structure members shown in FIGS. 8 through 10. It is needless to say that inner formworks 631, 632 and 633 shown in FIGS. 8, 9 and 10, and the inner formwork 69 as shown in FIG. 18 can be used for the structure members shown in FIGS. 17(A) through (C).

Although various types of structure members are exemplified, these structure members need be reinforced depending on shapes or uses thereof.

Figure 19:
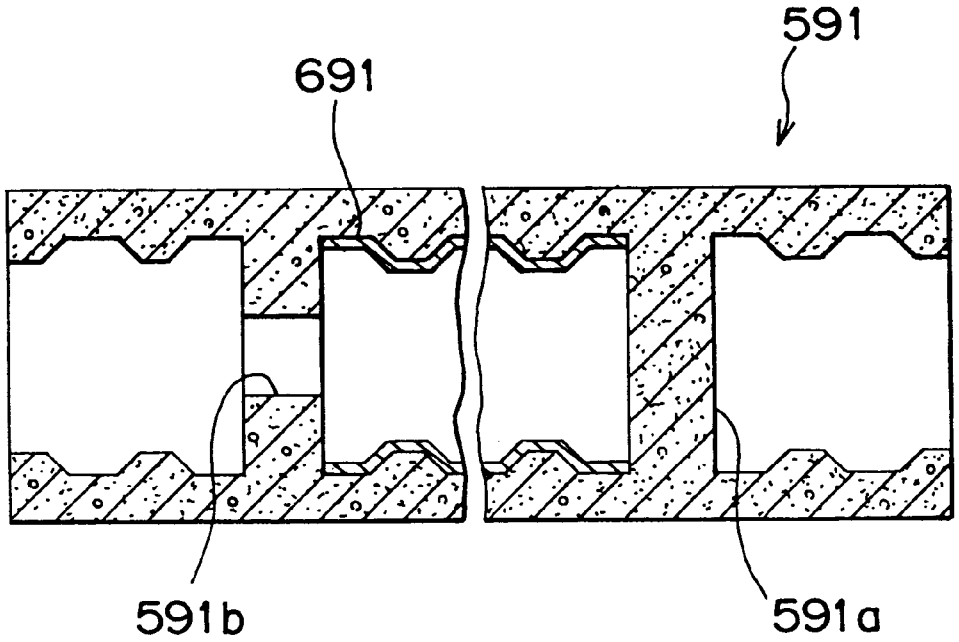
FIG. 19 is a cross-sectional view of a structure member according to an eighth embodiment which is subject to reinforcement.

FIG. 19 shows a structure member according to an eighth embodiment of the invention, wherein the structure member is reinforced. There are provided reinforcing parts 591*a* at appropriate positions inside a hollow tube of a structure member 591. The reinforcing part 591*a* may have one or plural openings 591*b* at a belly portion thereof. The reinforcing parts 591*a* may be integrated with the hollow tube or it may be made of a material which is the same as or different from that of the hollow tube wherein the reinforcing parts 591*a* are engaged with the hollow tube. A formwork 691 may be embedded in a space between two reinforcing parts 591*a*. Alternatively, it is possible to use an inner formwork made of a material which can be burnt and corroded, and the inner formwork may be removed after it is hardened. There is still another method to use an inner formwork made of rubber which is expanded by air, wherein the inner formwork can be taken out from the openings 591*b* after concrete is hardened. It is needless to say that such reinforcing parts may be formed in any type of structure member.

Described hereinafter are jointing methods of the structure members as set forth above.

Figure 20A:
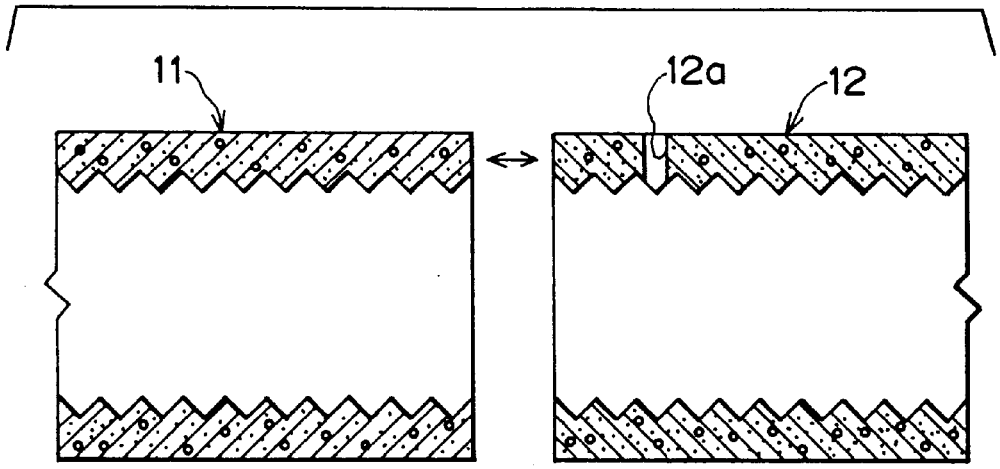
FIGS. 20(A) and (B) are cross-sectional views for explaining a first example of a jointing method of structure members.
Figure 20B:
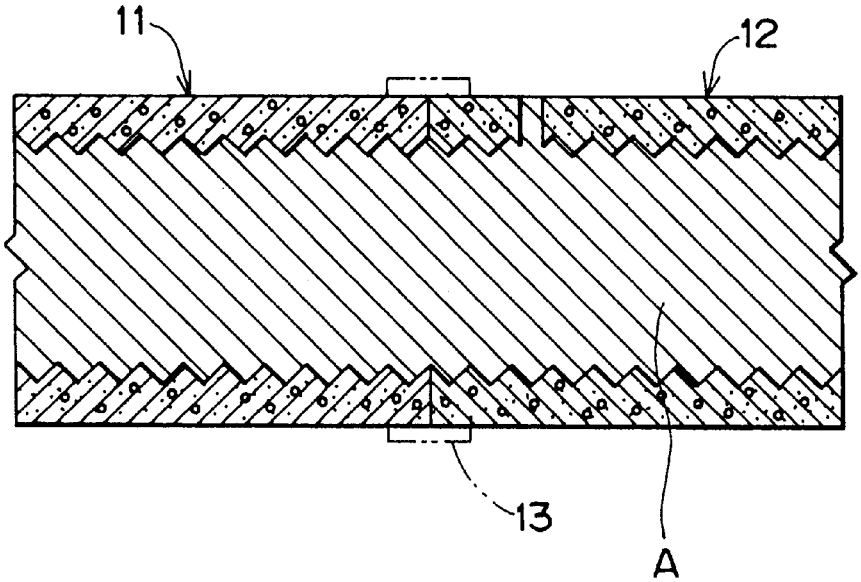
Figure 21A:
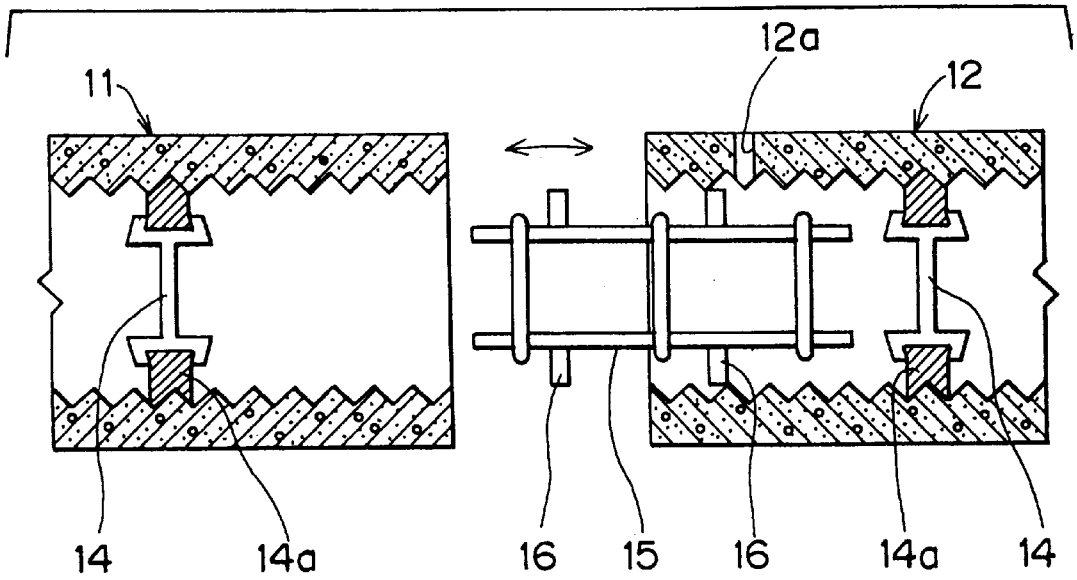
FIGS. 21(A) and (B) are cross-sectional views for explaining a second example of a jointing method of structure members FIGS. 22(A) and (B) are cross-sectional views for explaining a third example of a jointing method of structure members.
Figure 22A:
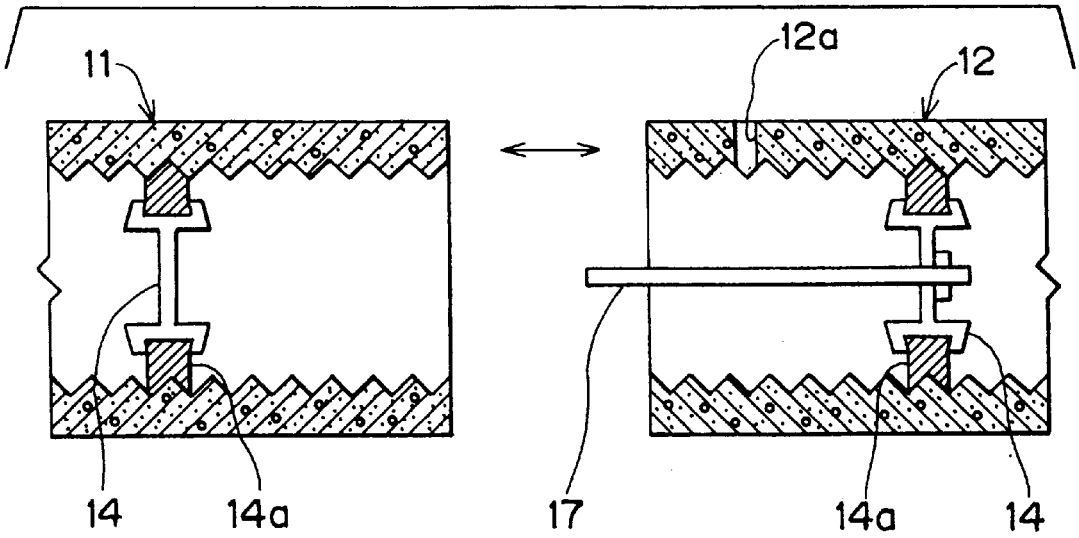

In a first example of the method shown in FIG. 20, end surfaces of two structure members 11 and 12 are butt-joined with each other, and a filler A is introduced from a filling port 12*a*. In this case, the filler A is filled in the entire hollow potions of the structure members 11 and 12. Temporary fixing members 13 are used for temporarily fixing the structure members 11 and 12, if need be. In a second example of the method shown in FIGS. 21(A) and (B), covers 14 are attached to each of the structure members 11 and 12 at end portions thereof to be jointed to each other by way of elastic members 14*a* at the peripheries thereof. A reinforcing member 15 having hooped rods is inserted into the structure member and it is fixed by spacers 16, etc. Thereafter, the end surfaces of the structure members 11 and 12 are butt-joined with each other, and the filler A is introduced into a space partitioned by the cover members 14. In case that the hollow portion of one of the structure members is small or when the cover members 14 are provided at the innermost portion of the structure member, an assistant rod 17 shown in FIGS. 22(A) and (B) is used. The assistant rod 17 is fixed to one of the cover members 14.

Figure 23A:
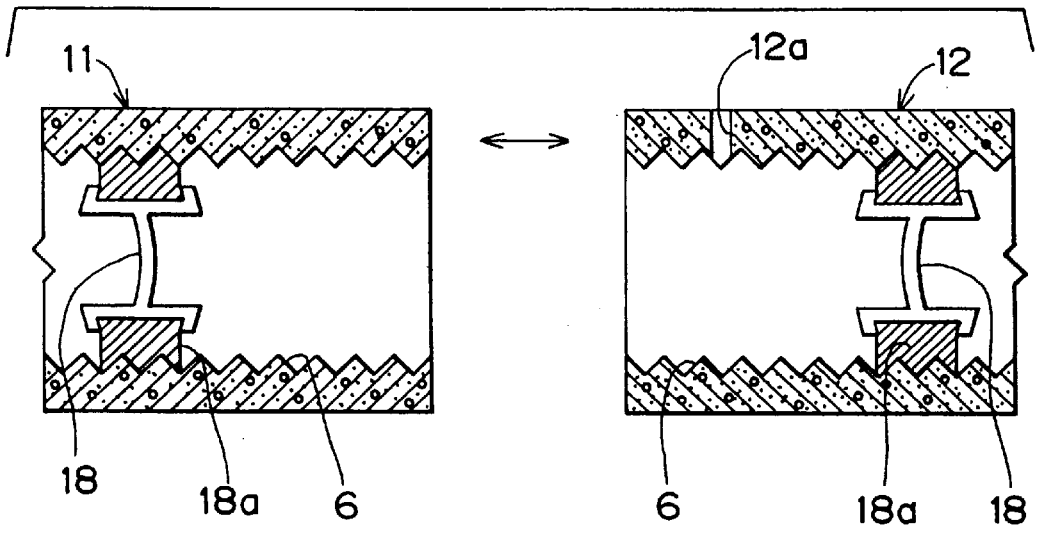
FIGS. 23(A) and (B) are cross-sectional views for explaining a fourth example of a jointing method of structure members.

In a fourth example of a jointing method shown in FIGS. 23(A) and (B), two structure members 11 and 12 respectively having helical irregular portions 6 are jointed with each other. Central portions of the cover members 18 have respectively spherical surfaces which are expanded toward end portions of the structure members 11 and 12. An adhesive, which has lubrication property when the adhesive is not hardened, is coated on the outer peripheries of the elastic members 18*a*, then the elastic members 18*a* of the cover members 18 are screwed along the irregular portion 6 until they reach predetermined positions. After the adhesive is hardened, the end surfaces of the structure members 11 and 12 are butt-joined with each other, and the filler A is introduced so that the central portions of the cover members 18 are expanded at the circumference thereof and the elastic members 18*a* are brought into contact with the irregular portions 6. Accordingly, there is no possibility that the filler A is leaked from gaps defined between the elastic members 18*a* and the irregular portions 6.

Figure 21B:
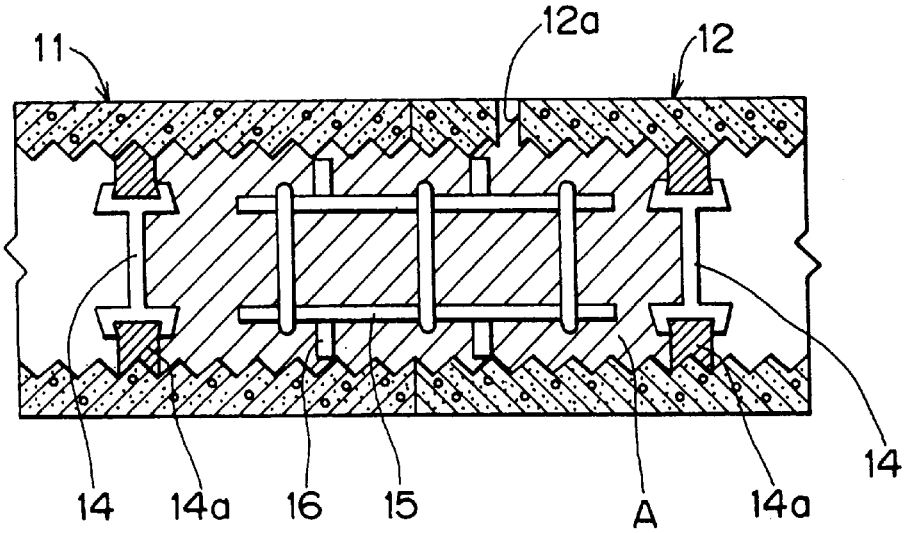
Figure 22B:
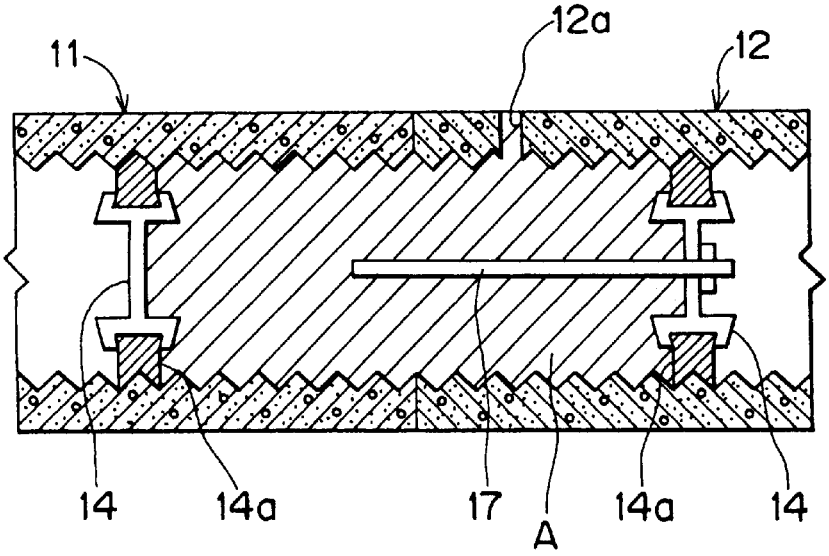
Figure 23B:
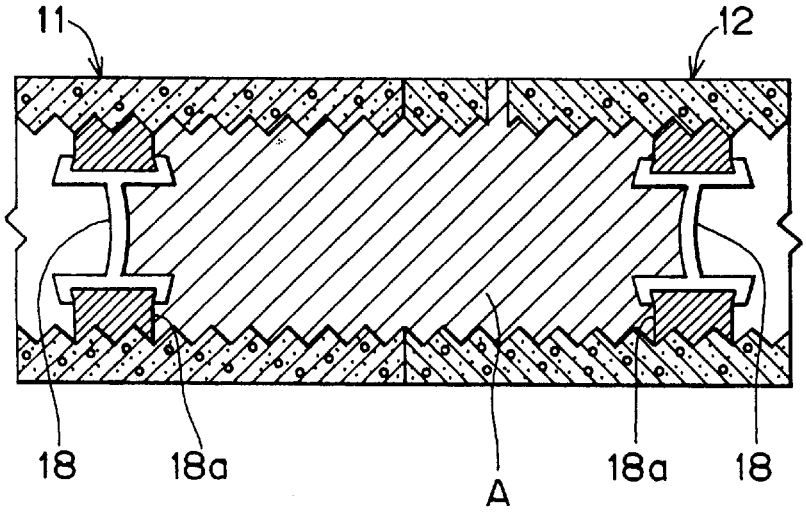

In FIGS. 21 through 23, if air in the space in which the filler A is introduced is not escaped from a gap between the jointing parts of the structure members 11 and 12, exhaust ports having appropriate sizes may be provided inside the cover members 18 or the structure members 11 and 12, and further there may be provided check valves or fillers 85, described later, in the exhaust parts for preventing the filler A from being leaked therethrough.

Figure 24:
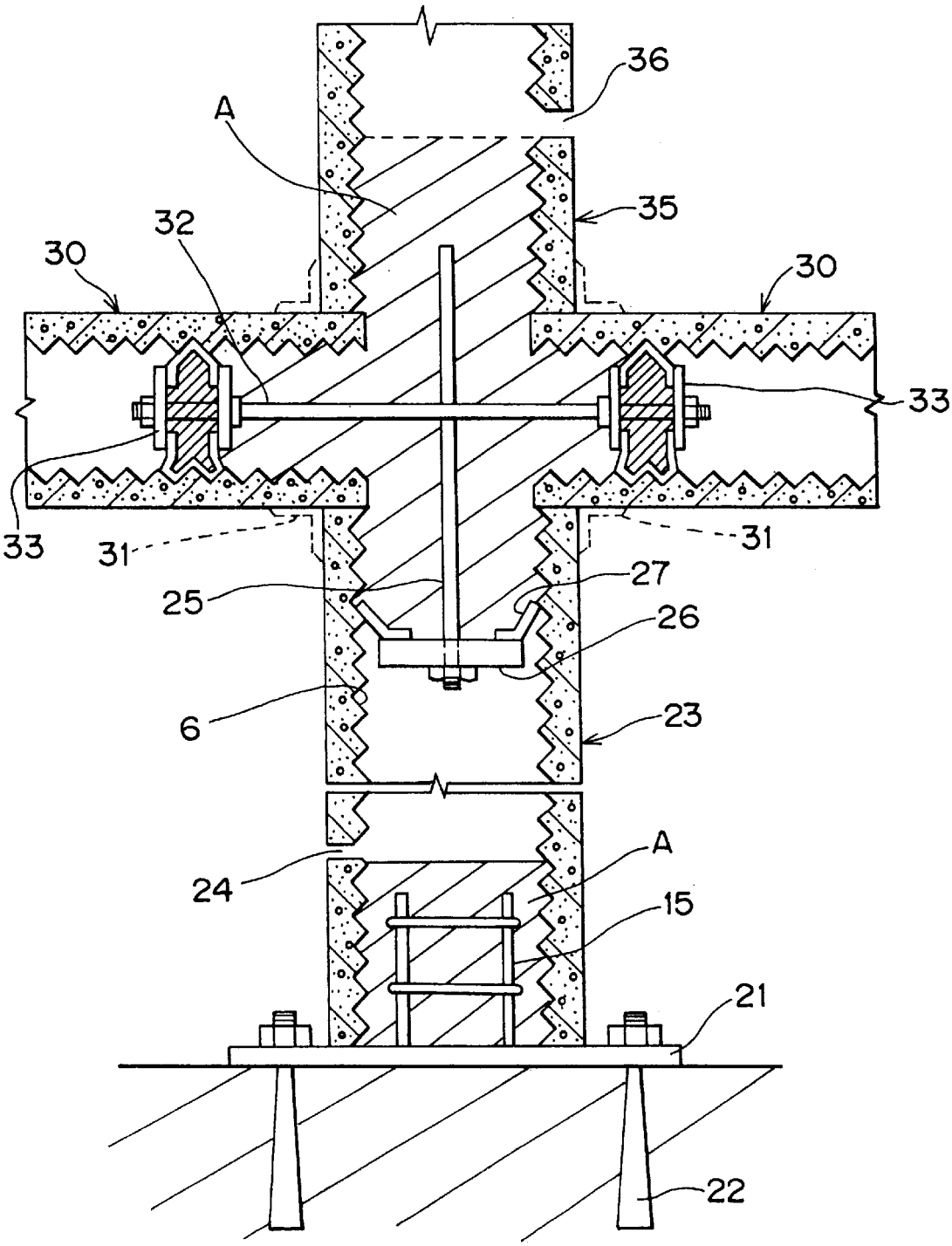
FIG. 24 is a cross-sectional view for explaining a jointing method of structure members in jointing parts.

Structure members constructed using the aforementioned jointing methods will be now described in succession with reference to FIG. 24 showing the jointing method of the present invention. Base plates 21 are fixed to anchors 22 which are embedded in concrete forming the foundation. A reinforcing member 15 is welded to the base plates 21, if need be, then a lower pillar 23 comprising the structure member is assembled and temporarily fixed at a given position of the lower pillar 23. Thereafter, the filler A is introduced into a port defined in the lower pillar 23 by a predetermined amount, if it is defined in the lower pillar 23, or from an upper opening of the lower pillar 23, if it is not defined in the lower pillar 23, then the lower pillar 23 is fixed to the base plates 21. The reinforcing member 15 may be directly embedded in the concrete of foundation without providing the base plates 21 and the anchors 22. Successively, the cover member 26 which is attached to one end of an assistance rod 25 is engaged in the lower pillar 23 from the upper opening of the lower pillar 23. In this method, springs 27 are provided at the periphery of the cover member 26 to reduce the gap between the cover member 26 and the irregular portions 6, so as to support the cover member 26 with the resiliency of the springs 27. If there is a likelihood that the cover member 26 falls down owing to the weight of the filler A, the upper end of the assistant rod 25 may be supported using an appropriate method.

Then, beams 30 and 30 respectively comprising the structure member are provided on the lower pillar 23 at both sides of the lower pillar 23 using a temporary fixing member 31, if need be. At this time, cover members 33 respectively disposed on both ends of a connecting rod 32 need be inserted into the beams 30 and 30. When the cover members 33 are inserted into the innermost part of one of the beams 30 so as to be out of the way of the opposite beam 30, then the opposite beam 30 is provided or installed, and thereafter the cover members 33 may be returned to their given positions. The cover members 33 may be provided at a factory or building sites, and the reinforcing member 15 may be attached to the cover members 33, if need be, in the manner as described with reference to FIG. 21. Finally, after an upper pillar 35 is provided on the beams 30 and 30, the filler A is filled into the space defined between the cover member 26 and the cover members 33 and 33 through a filling port 36 and it is solidified, then the lower pillar 23, the upper pillar 35, and the beams 30 and 30 which are respectively composed of structure members are jointed with each other. The beams 30 may be disposed or provided at three or more than four positions, or in a slanting direction, if need be, In the above method, the upper pillar 35 does not use the cover member since the filling port 36 is defined in the upper pillar at the upper portion over a given filling range, so that the filler A can be filled in the space owing to the gravity thereof. However, when the filler A is introduced through the filling port 36 under a given pressure while the cover member is fixed to the upper pillar 35 over the filling port 36, the strength of the filler A can be enhanced after it is solidified, and hence it is a preferable method. The filler A may be introduced into the upper space of the lower pillar 23 before the beams 30 and 30 are provided on the lower pillar 23.

In the arrangement as set forth above, as a method of attaching the cover members to the structure members so as to be fixed thereto, the elastic members to be attached to peripheries of the cover members are made hollow like a tire-shape of a vehicle, then the cover members are provided at given positions, successively compressed air is supplied inside the hollow portion of the elastic members so as to expand thereof, finally the elastic members are brought into contact with the irregular portions.

Figure 25:
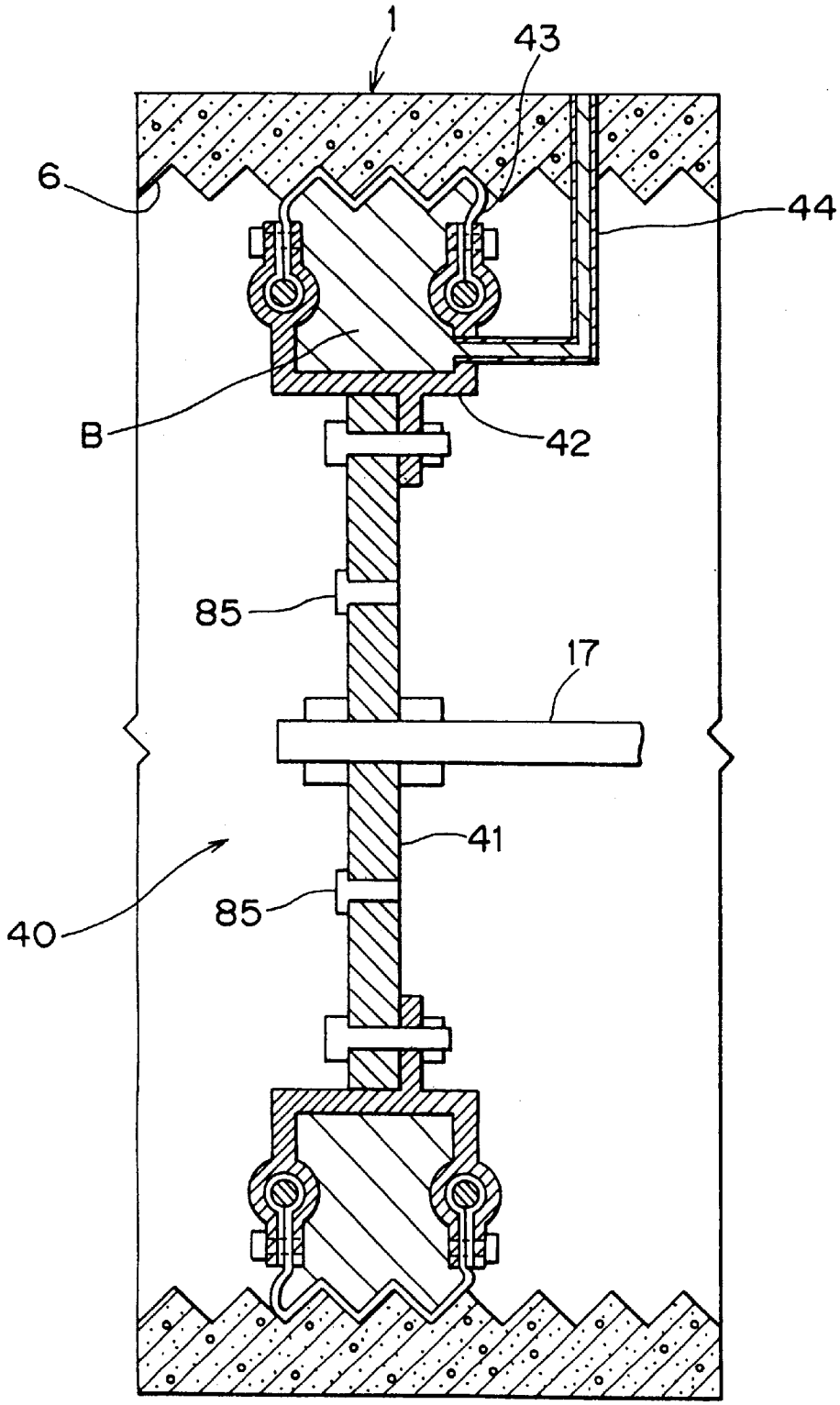
FIG. 25 is a cross-sectional view showing an example of a cover member.

FIG. 25 is a cross sectional view for explaining another method for attaching a cover member to the inside of a structure member so as to be fixed thereto. In this method, a cover member 40 comprises a plate member 41, and rim frames 42 provided at the periphery of the plate member 41, and ring-shaped bag bodies 43 attached to the rim frames 42, and an introduction pipe 44 which is connected to the rim frame 42. After the cover member 40 is inserted into the structure member 1 at a given position using an assistant rod 17, then a filler B is introduced from the introduction pipe 44 into the bag bodies 43 so that the bag bodies 43 are expanded to engage with the irregular portion 6 in the structure member 1. When the filler B is solidified, the cover member 40 is in a fixed state. According to this method, the cover member 40 can be brought into contact with and fixed to the inside of the structure member 1 even if the irregular portion 6 has a complex shape. It is also possible to employ a method for introducing the filler B from the rim frames 42 to the bag bodies 43 by way of the assistant rod 17 and the inside of the plate member 41.

In such a manner, the cover member 40 is attached to the inside of the structure member 1 while it is fixed thereto, and end portions of two or more structure members are butt-joined with one another according to the aforementioned method, then the filler A is introduced into the space partitioned by the cover member 40 and is solidified thereafter so as to joint the structure members with one another.

Figure 26:
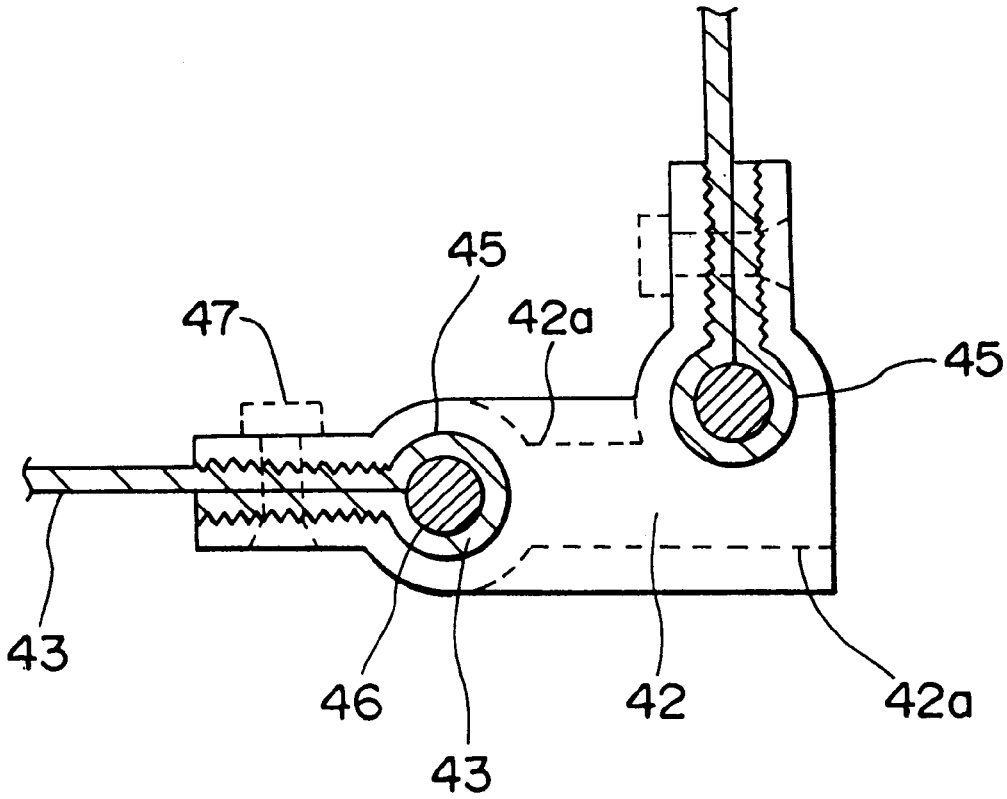
FIG. 26 is a cross-sectional view showing an example of a rim frame to which a bag body is attached.
Figure 27:
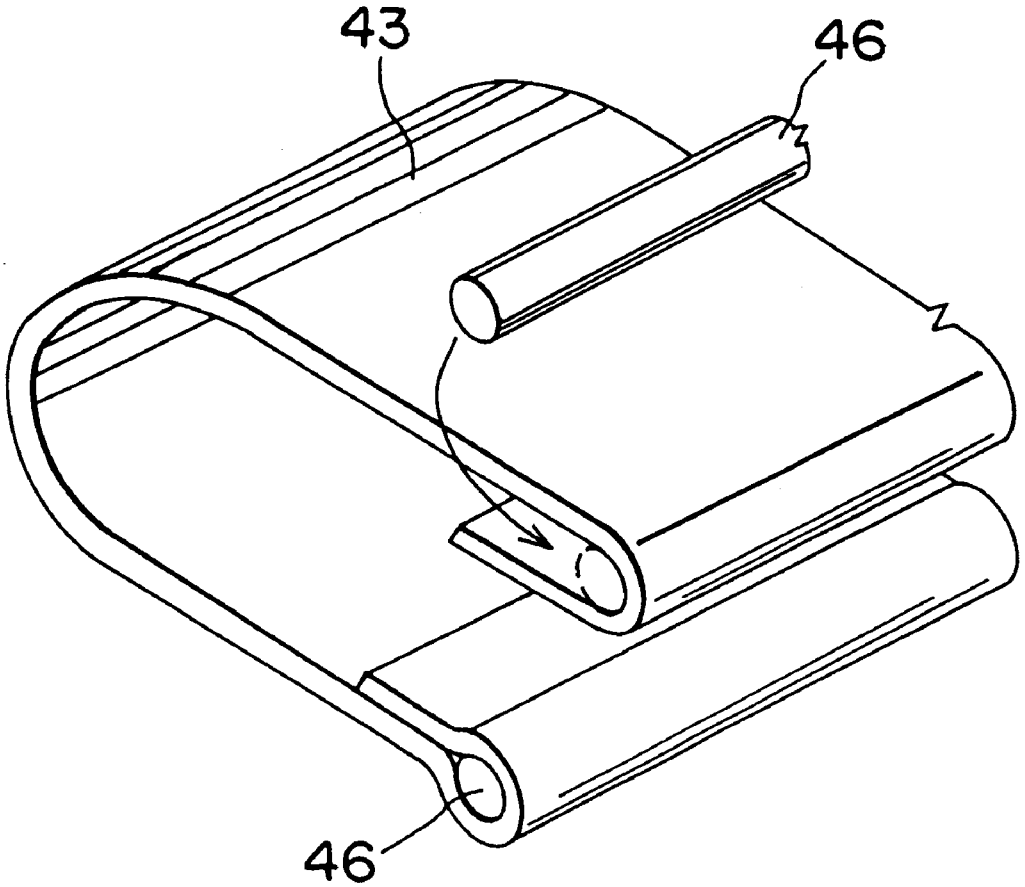
FIG. 27 is a perspective view showing a bag body and core rods respectively attached to the rim frame.
Figure 28:
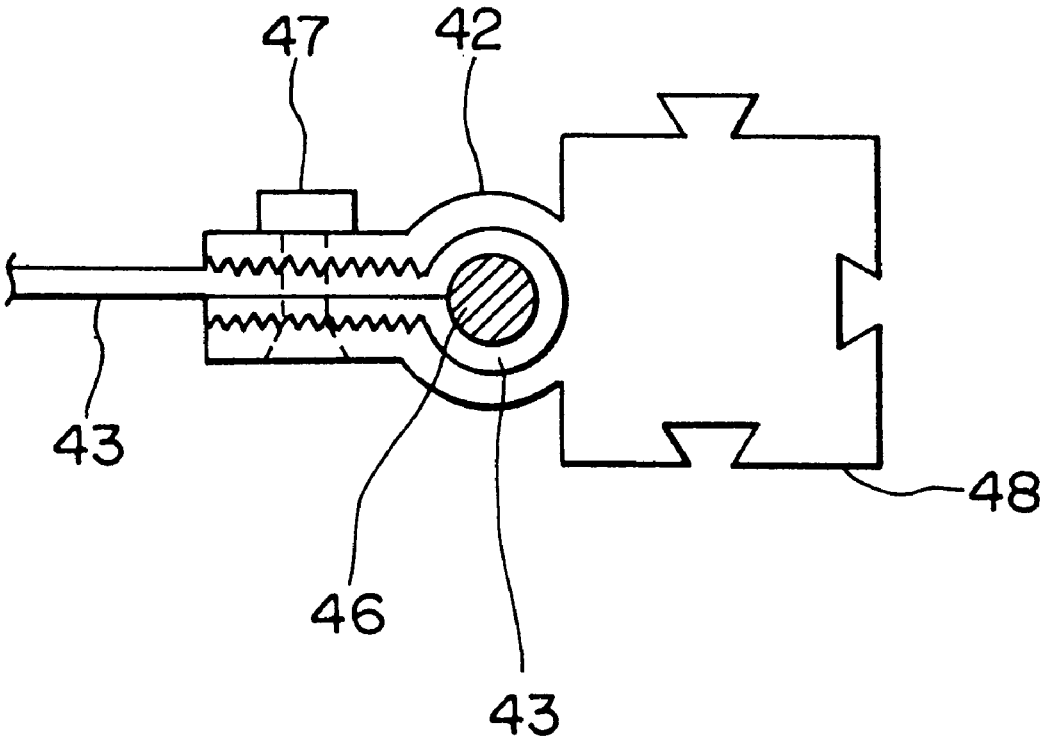
FIG. 28 is a cross-sectional view showing another example of a rim frame which a bag body is attached.

The bag bodies 43 are made of woven fabrics or unwoven fabrics formed by an organic or inorganic material such as rubber, ceramics, nylon, aramid, carbon, glass fibers, and they may be coated with an organic polymeric material. The bag bodies 43 are attached to the rim frames 42, for example, as shown in FIGS. 26 and 27. The tip end of each rim frame 42 can be divided and opened into two parts, as shown in FIG. 26 and it is hollow. As shown in FIG. 27, the tip ends of the rim frames 42 are arranged in a manner that core members 46 can be wrapped by end portions of the bag bodies 43 and they can be inserted into hollow portions 45 of the rim frame 42, then the bag bodies 43 and the rim frame 42 are fixed to each other by screws 47. When the core members 46 are inserted into the hollow portions 45, the rim frame 42 may be narrowed when the elastic opening of the hollow portions 45 is inferior depending on a material of the rim frames 42 as illustrated by dotted lines 42*a*. In case of providing such rim frames 42 to be adjoined with each other, a square member 48 having dovetails and tenons may be added to the rim frame 42 as shown in FIG. 28. There are provided only the square members which are combined with one another, if need be, and which can be utilized for regulating the interval between the frames. The material of the rim frame 42 may be iron, nonferrous metals, inorganic or organic fibers such as resins, ceramics, carbon fiber and aramid, which is solidified.

In the method of jointing the structure members using the cover member as explained in the aforementioned examples, each cover member need be fixed to the inside of each structure member so as to be fixed thereto. Described next is a case where the cover member is attached to one side of the structure member.

Figure 29:
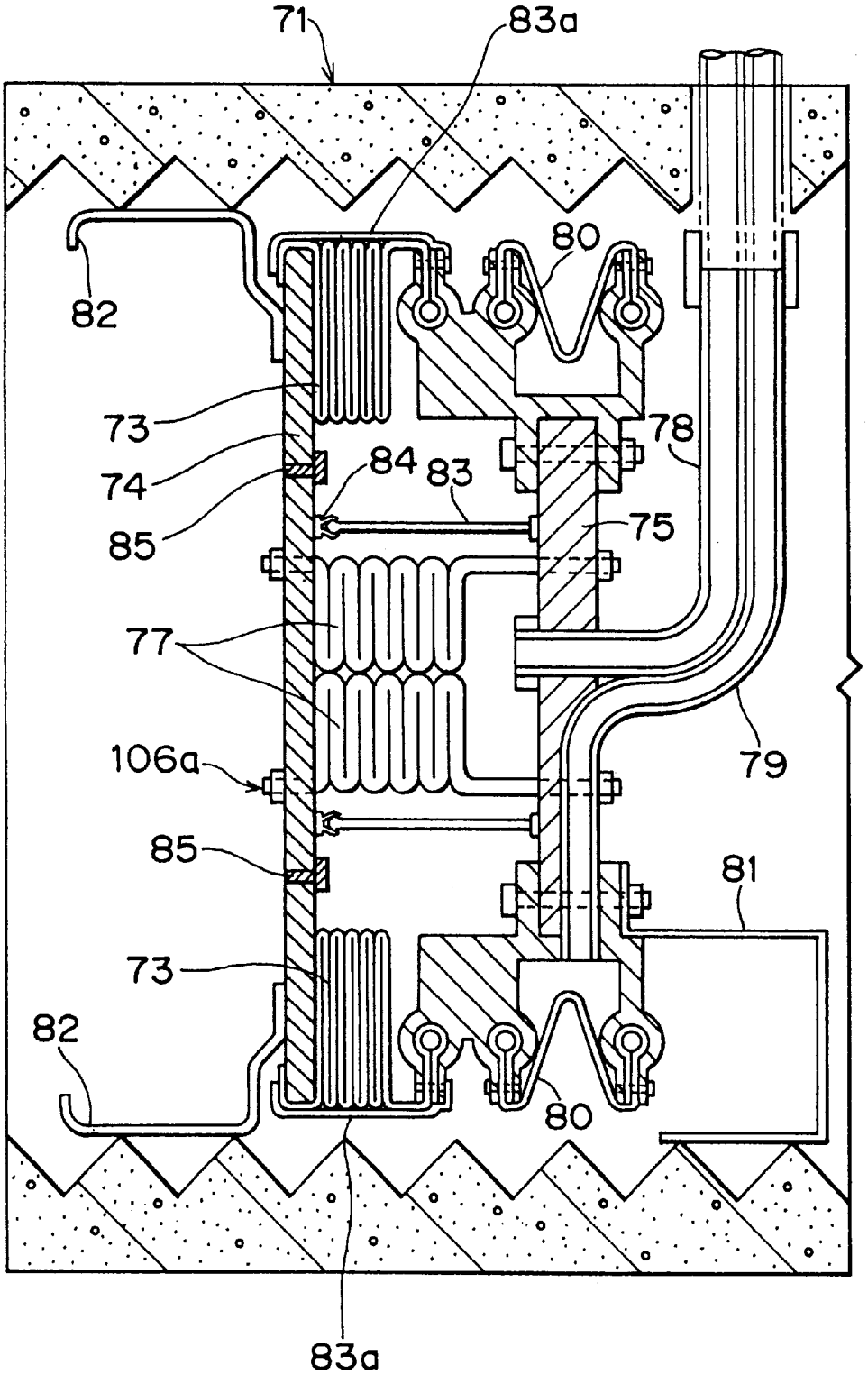
FIG. 29 is a cross-sectional view of a structure member to which bag bodies attached.

FIG. 29 is a cross sectional view of a structure member 71 to which bag bodies 73 are attached while they are contracted at the portion adjacent to the end portion of the structure member 71 which is to be jointed with another structure member. The bag bodies 73 are clamped by plate members 74 and 75 from the front and rear portions thereof and they are maintained in a contracted state by retaining members 83 and 84 or adhesive tapes 83*a*, wherein binding members 77 like bendable cords such as chains, wires, and ropes are accommodated into the bag bodies 73 while they are contracted. The middle portion of the bag body 73 is connected to an introduction pipe 78 fixed to the rear plate member 75. The introduction pipe 78 is arranged in parallel with another introduction pipe 79 which is connected to a ring-shaped bag body 80 provided at the periphery of the plate member 75. The bag bodies 73 remained positioned at the center of the hollow portion by spacers 81 and 82 which are provided at several portions of the front and rear plate members 74 and 75.

Figure 30:
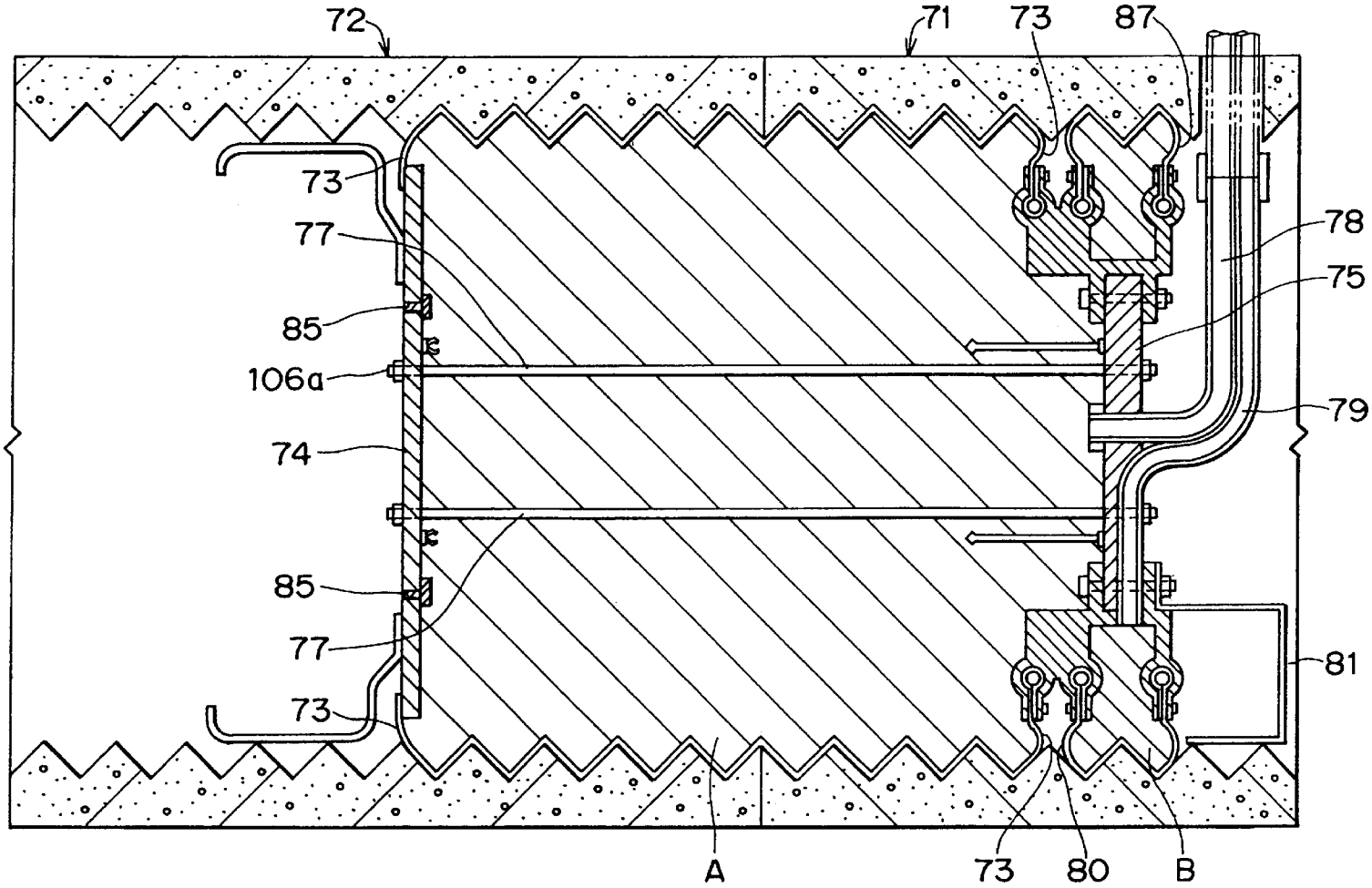
FIG. 30 is a cross-sectional view showing a jointing state using the structure member of FIG. 29.

FIG. 30 is a cross sectional view showing a jointing state between the structure member 71 and another structure member 72. When the structure members 71 and 72 are jointed with each other, both end portions thereof are butt-joined with each other, then the filler B is introduced into the bag body 80 from the introduction pipe 79 so as to expand the bag body 80 while the rear plate member 75 is made in a fixed state, then the filler A is introduced into the bag bodies 73 through the introduction pipe 78 so as to expand the bag bodies 73. Accordingly, the bag bodies 73 extend into the confronted structure member 72, and at the same time, they are engaged with the irregular portion formed at the inner surface of the hollow portion, wherein the filler A filled in the bag bodies 73 is solidified to joint the structure members 71 and 72. There are provided filters 85 in the front plate member 74 for permitting air to pass therethrough but not permitting the filler A to pass therethrough. When the filler A is introduced under pressure into the bag bodies 73, air remaining in the bag bodies 73 is discharged so as to prevent the bag bodies 73 from being hollow locally. When introducing the filler A, the retaining members 83 and 84 or the adhesive tapes 83*a* are removed by the filling pressure. The shape of the irregular portion formed inside the structure member 71 is determined arbitrarily. Accordingly, if a thickness of the plate member 74 is increased, the plate member 74 and the binding members 77 are not necessarily provided. Even if the thickness of the plate member 74 is not increased, it is possible to restrain the bag bodies from extending in a longitudinal direction of the structure member when using the cover members 14, etc. as illustrated in FIGS. 21 through 23.

Figure 31:
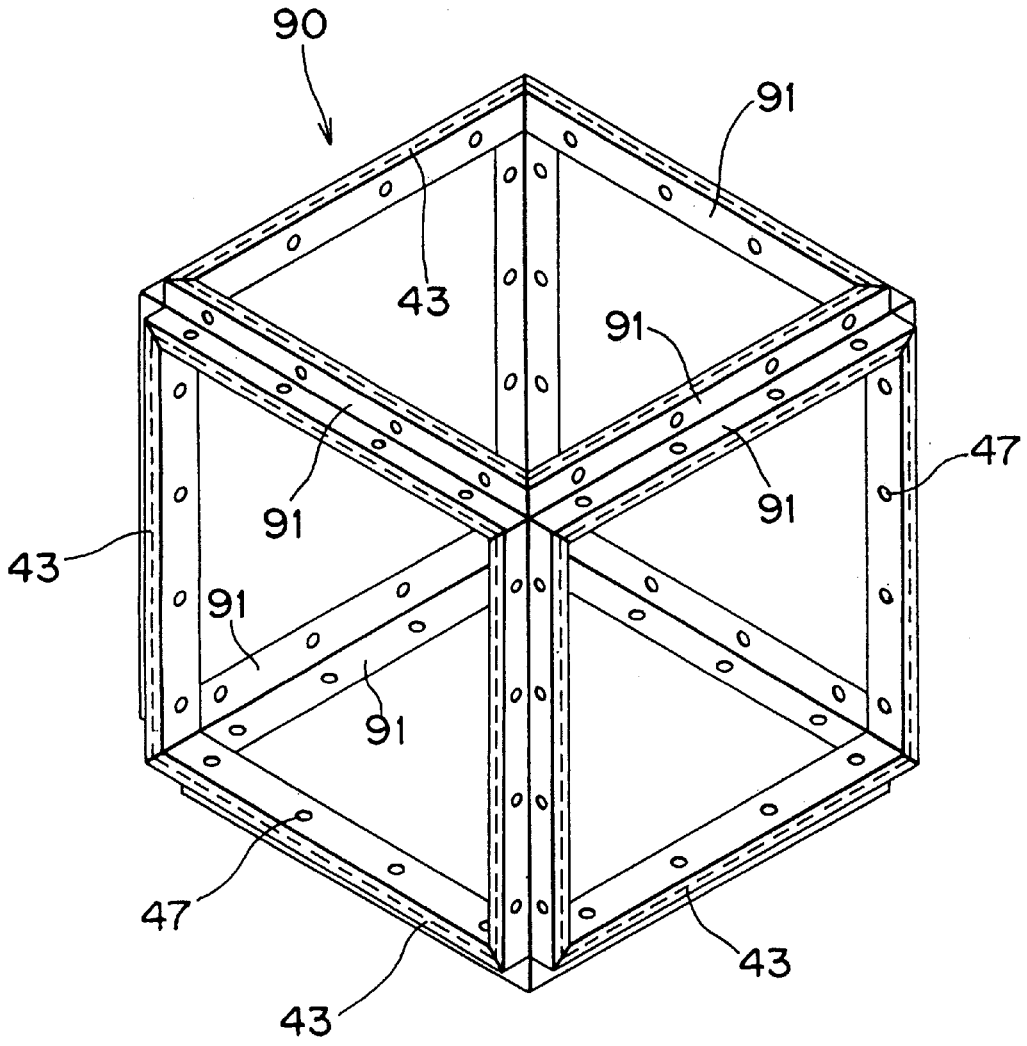
FIG. 31 is a perspective view showing an example of a jointing frame.
Figure 32:
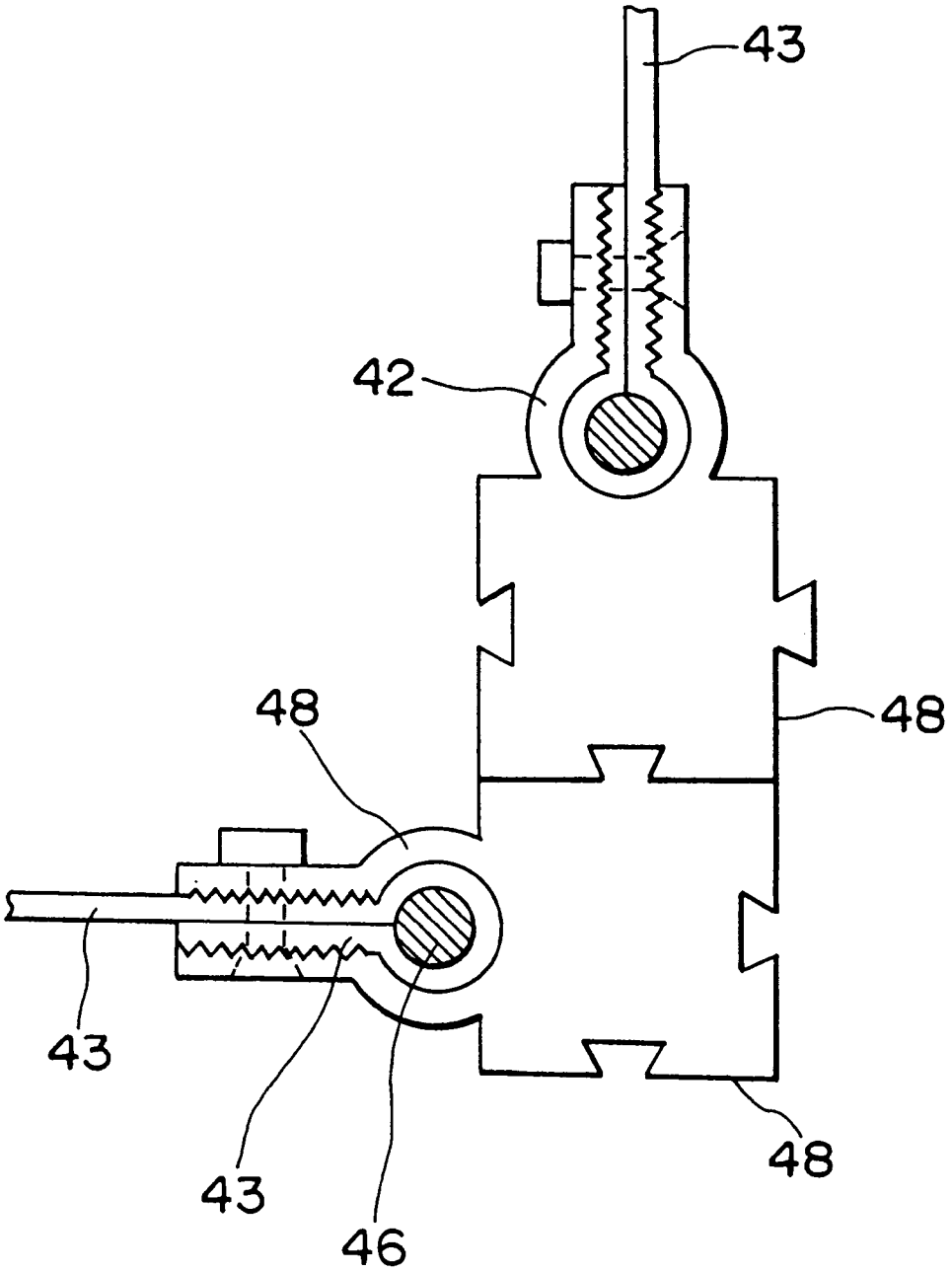
FIG. 32 is a cross-sectional view showing an example of a part of the bags which are attached to the jointing frame of FIG. 31.

The method for jointing the structure members by introducing the filler into the single bag body so as to be solidified is troublesome in respect of jointing and supporting the bag bodies in the manner of jointing the structure members in such a case where the beams are provided at the jointing points between the upper and lower pillars. In such a case, a jointing frame 90 shown in FIG. 31 is employed to join the bag bodies. The jointing frame 90 comprises one or more frame bodies 91 which can be attached thereto with an arbitrary angle, wherein the bag bodies can be attached to the structure member in the manner as illustrated in FIGS. 26 and 27, wherein each of the frame bodies 91 has an appropriate shape depending on the number of and angles defined at the jointing points between the structure members. The rim frames 48 having the square members as shown in FIG. 28 are connected and assembled with each other utilizing dovetails and tenons as shown in FIG. 32 so as to form the jointing frame 90 instead of employing the frame bodies 91.

Figure 33:
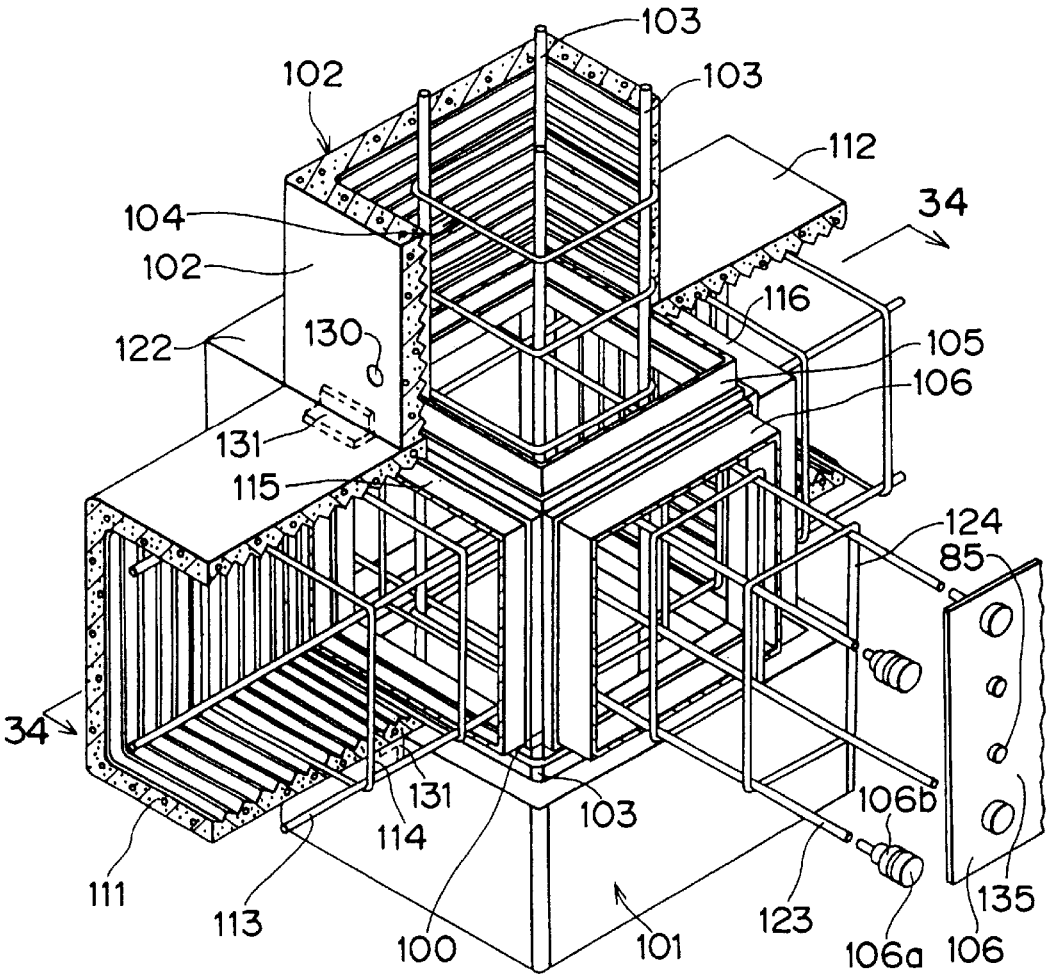
FIG. 33 is a partly cut perspective view of structure members for explaining a jointing method of structure members in the jointing parts.
Figure 34:
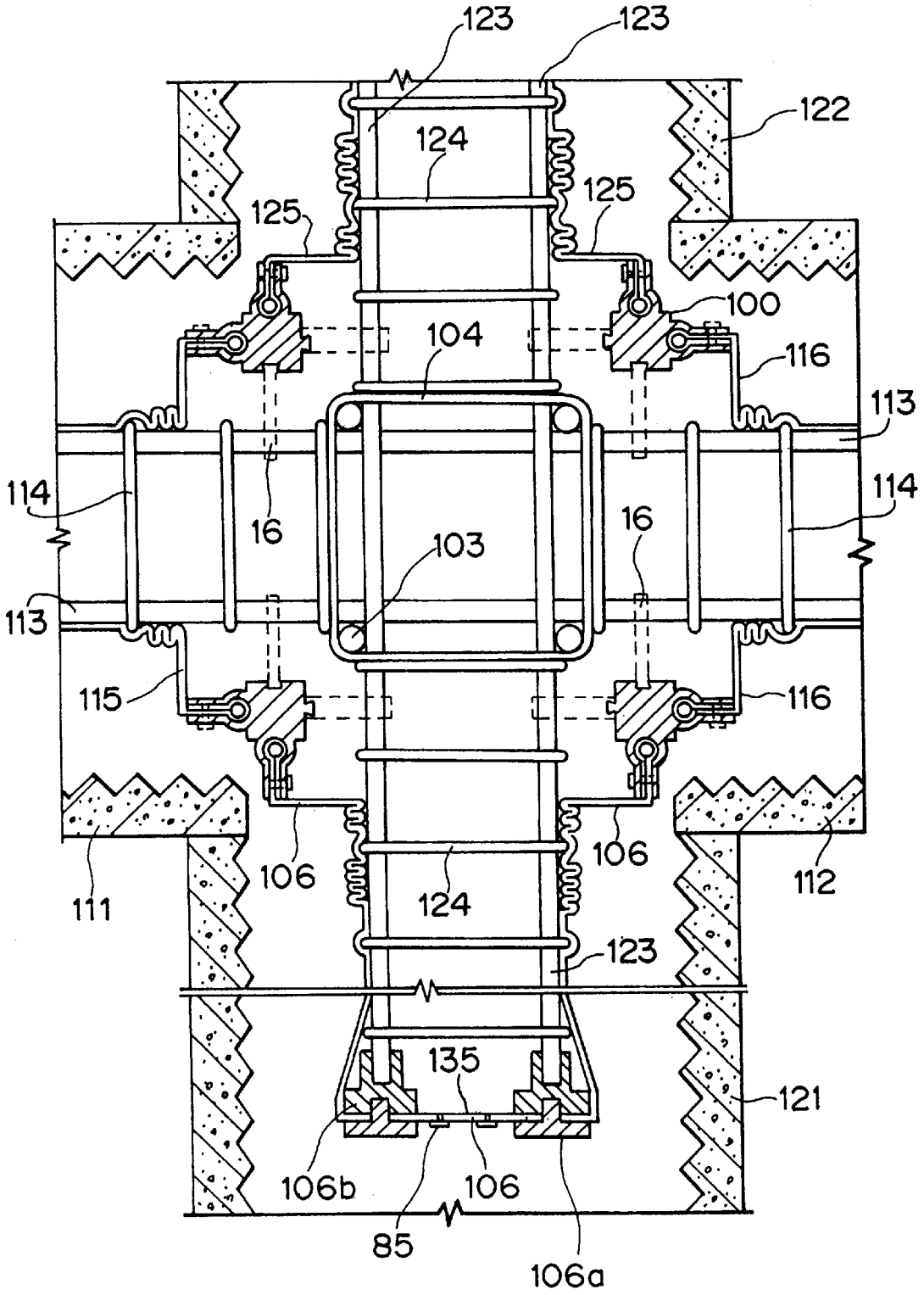
FIG. 34 is a cross-sectional view taken along lines 34—34 in FIG. 33.

Described next is a method of jointing three or more structure members utilizing such jointing frames 90. The method of jointing the jointing structures shown in FIG. 33 is a case where beams are jointed between lower and upper pillars in four directions, wherein a cross section of a main portion taken along A—A of FIG. 33 is shown in FIG. 34 and a case where the filler is filled in the structure members in FIG. 34 is illustrated at the lower half portion of FIG. 35. Jointing frames 100 are provided on the upper end of a structure member 101 comprising lower pillars, and main pillar rods 103, main beam rods 113 and 123 are respectively disposed to be accommodated inside the jointing frames 100. The jointing frames 100 are supported by the main pillar rods 103 when there are provided the main beam rods 113 and 123, and they are supported by the structure member by way of the spacer 16 when there are not provided the main beam rods 113 and 123. At this time, the main pillar rods 103 and main beam rods 113 and 123 are respectively reinforced by stirrup rods 104, 114, and 124. Successively, each one end of the bag bodies 105, 106, 115, 116, and 125 is attached to open surfaces of the jointing frames 100. These bag bodies are aligned with these main rods while they are contracted, and these bag bodies are clamped by nuts 106*a* attached to distal ends of the main rods so as to prevent the bag bodies from moving in an extending direction of the structure member. In such a manner, the bag bodies serve as a cover member 135. The nuts 106*a* are screwed into fixed plates 106*b* fixedly connected to the main beam rods 123. Thereafter, structure members 111, 112, 121, 122 of the beams are temporarily fixed to the structure member 101 of the lower pillar using the temporary fixing members 131, and a structure member 102 is provided temporarily on the structure members 111, 112, 121, 122, and the upper structure member 102 is temporarily fixed to the structure members 111, 112, 121, 122 using the temporary fixing members 131.

Since a filling pipe is provided in a filling port 130 by penetrating bag bodies and frame bodies, when the filler A is filled into the bag bodies through the filling port 130, each of the bag bodies 105, 106, 115, 116 and 125 is expanded to be brought into contact with the irregular portions 6 of each structure member. When the filler A is solidified, the structure members are integrally jointed to one another. Since expansible material is mixed with the filler A, the pressure inside the bag bodies is increased to increase an application force with respect to the irregular portions of the structure members.

Figure 35:
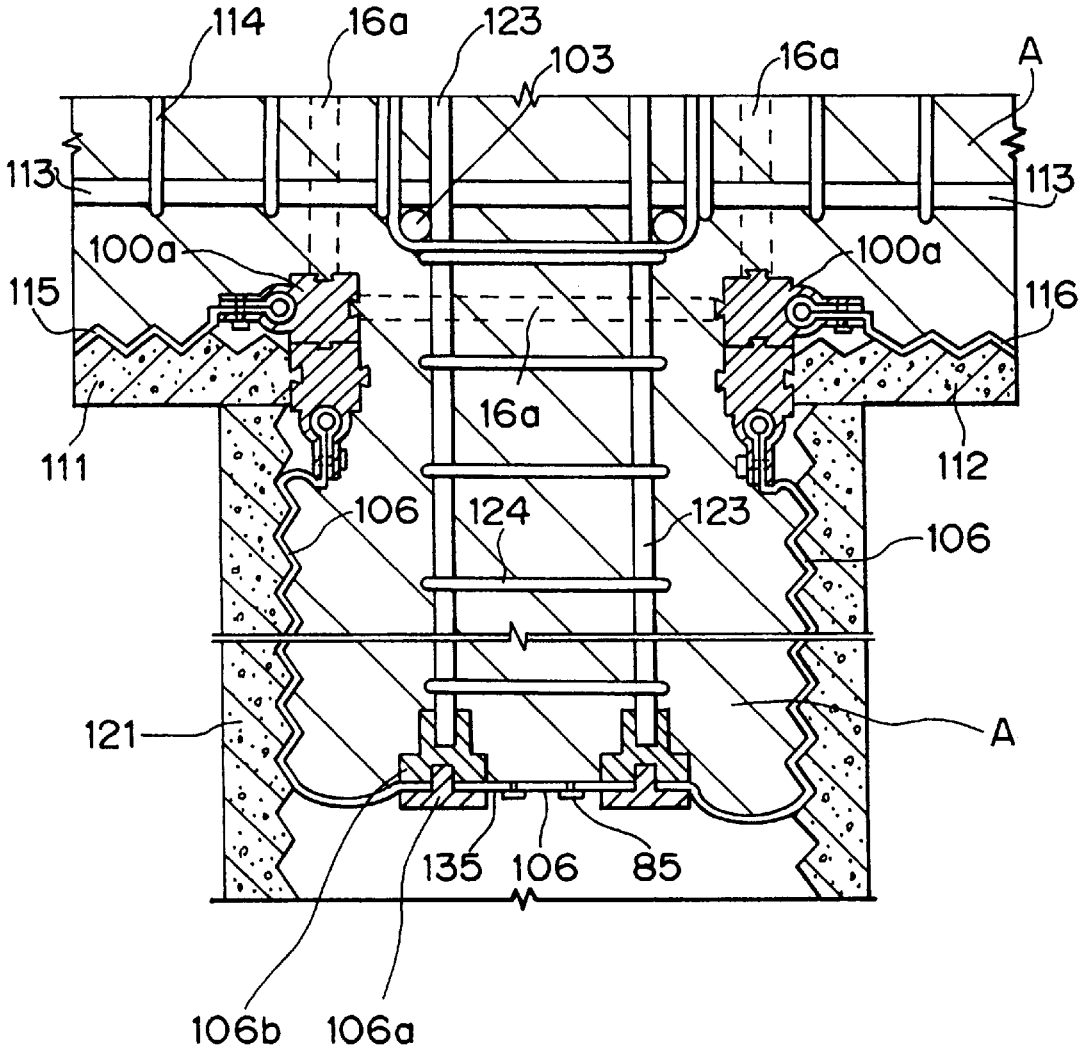
FIG. 35 is a cross-sectional view of the structure members of FIG. 33 in which a filler is filled.

In the cases shown in FIGS. 33 through 35, the bag body is not utilized by the lower pillar 101 but it is utilized by the structure member 102 as mentioned earlier. In the jointing between the pillars and beams, it is possible to embed or not embed the reinforcing members and bag bodies in the structure members, to combine any of these members or to select an appropriate method depending on the object of that structure.

In FIG. 35, the jointing frames 100*a* comprise two rim frames 48 having square members which are overlaid one with another as shown in FIG. 32. End edges of a partition plate 16*a* defining holes therein having appropriate sizes, at need, are engaged with dovetails and tenons of the jointing frames 100*a* along the four sides thereof. This is provided for enhancing strength of the jointing frame 100*a* so that the filler can be filled in each of beams.

Figure 36:
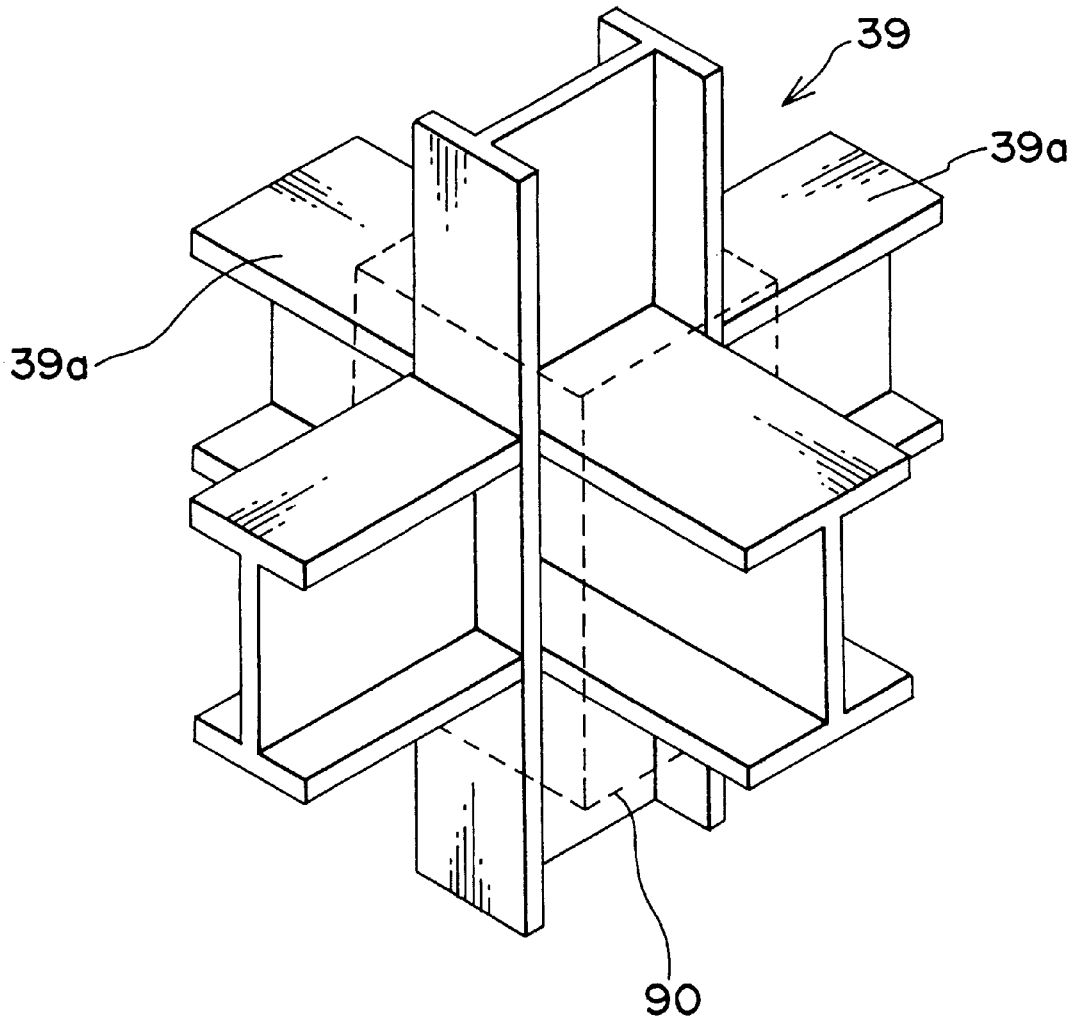
FIG. 36 is a perspective view of reinforcing members to be used in the jointing parts.

FIG. 36 is a perspective view showing jointing parts between the beams and pillars, namely, reinforcing members to be used at the joining portions.

In FIGS. 33 through 35, the reinforcing members comprise the main pillar rods 103 and main beam rods 113 and 123 and the stirrup rod 104 to be attached to these rods. There is a case that steel frames 39*a* are used so as to increase the cross sectional areas of the structure members or enhance strength of the joining of the structure members.

FIG. 36 is a case where the steel frame is used as a reinforcing member. When the jointing frame 100 is attached to a reinforcing member 39 made of a steel frame, at need, it may be provided as shown by dotted lines, or other ends of the bag bodies may be directly fixed to the steel frame or reinforcing rod. The reinforcing member 39 can use the main pillar rods 103 and the main beam rods 113 shown in FIG. 33. Further, the shape of the reinforcing member may be rectangular, circular or L-shaped or the material of the reinforcing member may have irregular portions, if need be. The material of the reinforcing member is not limited to iron, but it may be nonferrous metals, concrete, ceramics or inorganic or organic fibers such as carbon and nylon which are bundled.

Figure 37A:
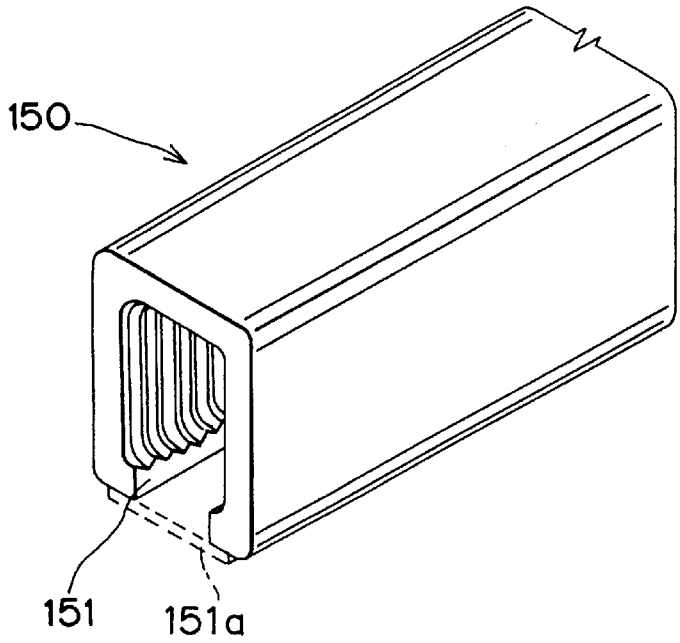
FIGS. 37(A) and (B) are perspective views each showing a structure member having a hollow tube a part of which is notched.
Figure 37B:
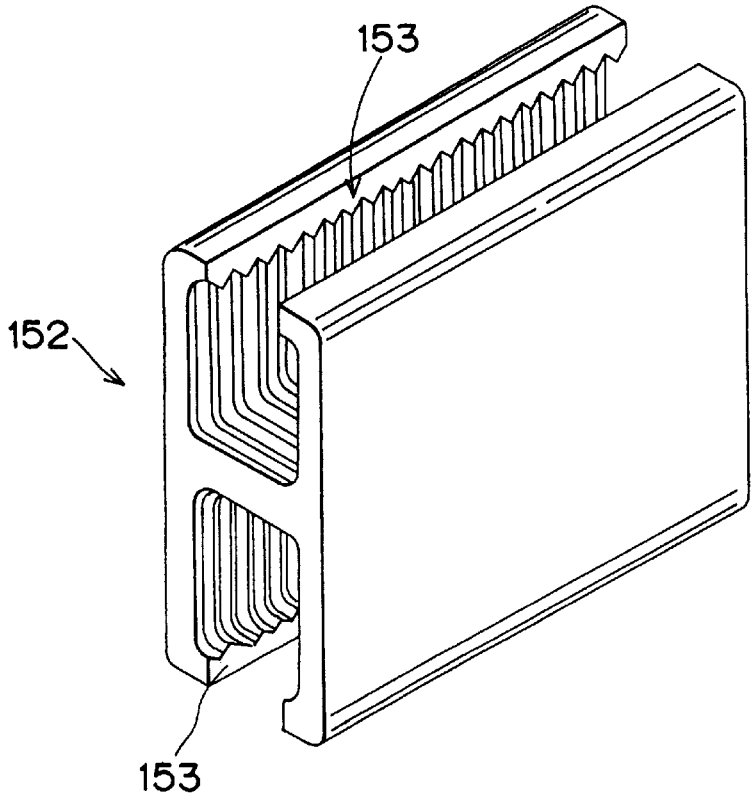

A structure member as illustrated in FIGS. 37(A) and (B) may be used in case that the structure members of the beams can not be fixed while the main beam rod 113, etc. are moved appropriately when the structure members of the beams are provided after a plurality of structure members comprising pillars are assembled to provide the reinforcing member of the jointing members shown in FIG. 33, and in case that the reinforcing member 39 made of steel frame shown in FIG. 36 is used. FIG. 37(A) is a perspective view of a structure member 150 comprising a hollow tube a part of which is notched, and FIG. 37(B) is a perspective view of a double hollow tube 152 each of which is notched. The length of each notch 151 or 153 of each structure member may be limited to a part or an entire of the reinforcing member depending on the object of the structure member. A formwork 151*a* may be provided to a portion where a filler is leaked out when the filler is introduced into the jointing parts. If the bag bodies are used, the formwork 161*a* may be used or not used depending on object and shape of the bag bodies. If the bag bodies are fixed to the reinforcing members, the notches 151 and 153 of the structure members may be positioned at any part thereof, namely, up or down, or left or right and these positions may be determined depending on the object of use of the structure member. If such structure members 150 and 151 are used, the beams can be easily assembled.

Figure 38:
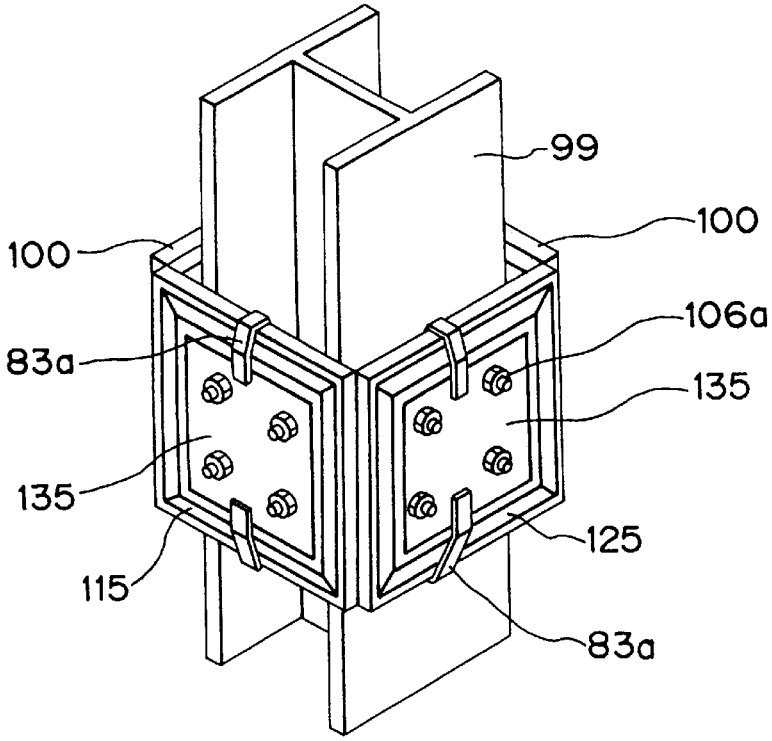
FIG. 38 is a perspective view of a reinforcing member in a jointing part.

It is preferable to adopt the structure as illustrated in FIG. 38, if the site where the structure members are used is a location to which a stress is mechanically applied or the structure members having the notches 151 and 153 are not intended to be used. FIG. 38 is a perspective view of the structure member having a jointing frame of the jointing part is positioned between the pillar and the beam. In FIG. 38, the jointing frame 100 having the jointing frame 90 to which a bag body is attached is fixed to the jointing part of the steel frame 99 at an appropriate method.

The bag bodies 115 and 125 are folded and accommodated in the jointing formwork 100, and then they are temporarily fixed by the adhesive tape 83*a*. The restraining members 77 are fixed to the covers 135 by bolts 106*a* as explained in FIG. 29, or directly fixed to the jointing frame 100 or directly fixed to the steel frame 99 by the bolts 106*a*, etc.

Even in case of the jointing shown in FIG. 33, the jointing method shown in FIG. 38 can be utilized. After the cover members 135, etc. are provided on the lower pillar 101 at an appropriate position thereof, the steel frame 99 is assembled in the hollow portion of the lower pillar 101, and filler is filled, at need, Then, after the beams 111, etc. are disposed at the position of the jointing frame 100, the upper pillar is disposed. The filler A is filled in the bag body and the formwork through the filling port 130 which penetrates the bag body and the formwork. The cover member is provided on the upper pillar 102, at need, and the adhesive tape 83*a* is peeled off by the filling pressure so that the bag body is opened to introduce the filler A therethrough. When the cover member is provided on the beam, the bag body 135 and the restraining member 77 are unnecessary. If this jointing method is used, the notch 151, etc. are unnecessary.

Figure 39:
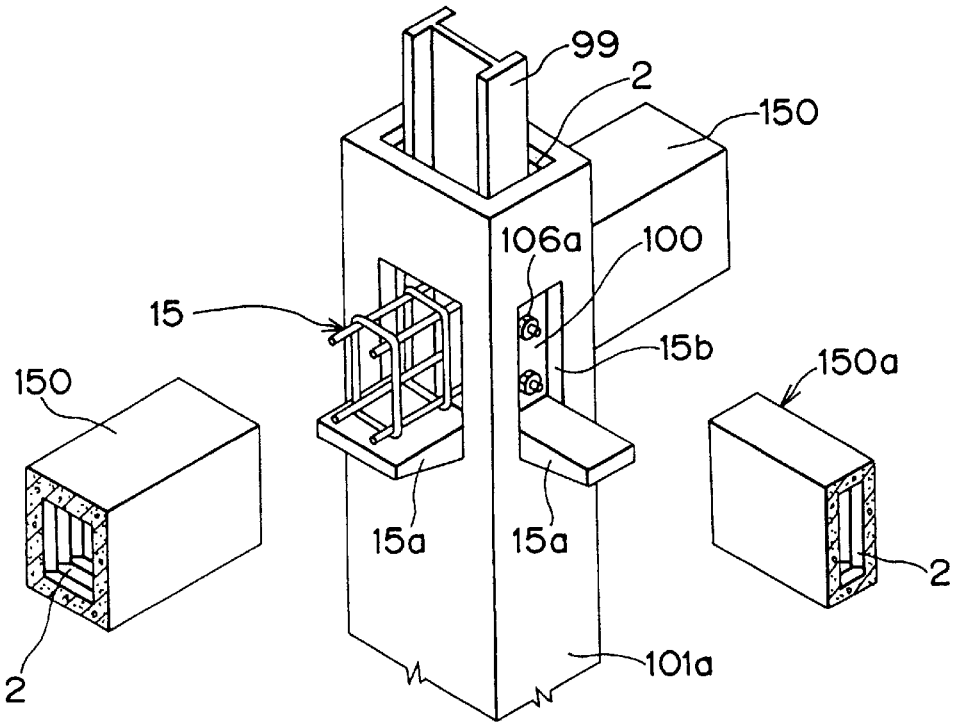
FIG. 39 is a perspective view showing assembly of the reinforcing member in another jointing parts.

FIG. 39 is a perspective view explaining another jointing in a structure member. In the same figure, the notches 15*b* having the shapes corresponding to those of beams are defined in the lower pillar 101*a* at the portion where the beams are jointed to the lower pillar 101*a*, and projecting plates 15*a* are provided at the lower ends thereof, at need. The projecting plates 15*a* support the load applied to the beams and they may be replaced by the formwork if notches 15*b* , etc. are provided. In FIG. 39, a reinforcing member 15 formed by a reinforcing rod is provided. That is, holes through which the reinforcing rods penetrate, are defined in the web surfaces of the steel frame by a given number at regular intervals. After the steel frame is assembled, the iron rods are inserted into the holes. The jointing frame 100 is attached to a flange surface of the steel frame in an appropriate method as shown in FIG. 38. Accordingly, the reinforcing rod and the bag body can be used together in the jointing of the beams. After the beams 150 and 150*a* are respectively disposed and temporarily fixed, the upper pillar is placed on and temporarily fixed to the lower pillar 101*a*, then the filler is introduced through the filling port. In this jointing method, if the beam 150, etc. are engaged into the notches 15*b* of the pillar, a firm jointing can be formed.

Figure 40A:
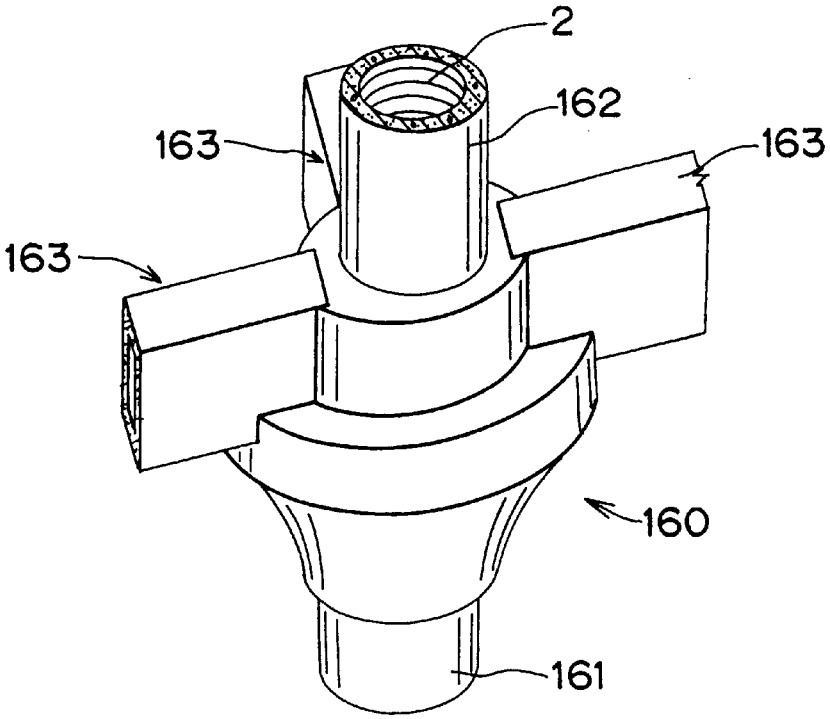
FIGS. 40(A) and (B) are perspective view each showing a jointing member.
Figure 40B:
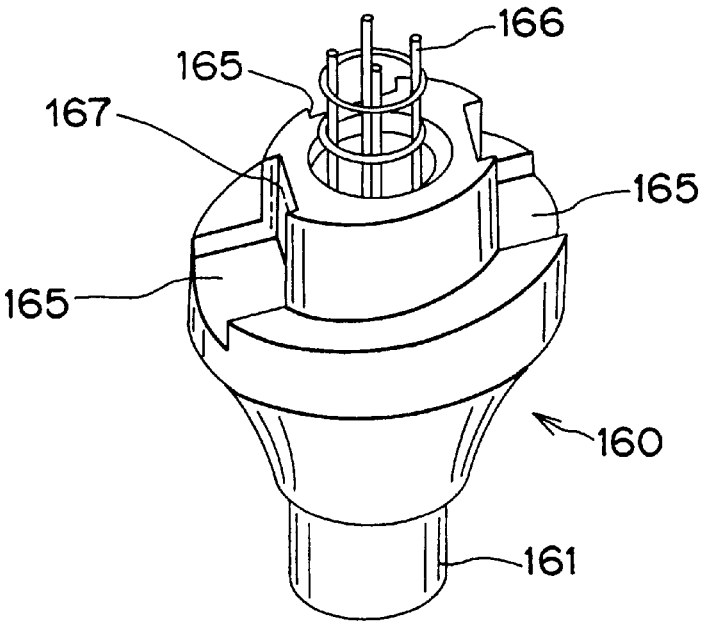
Figure 41:
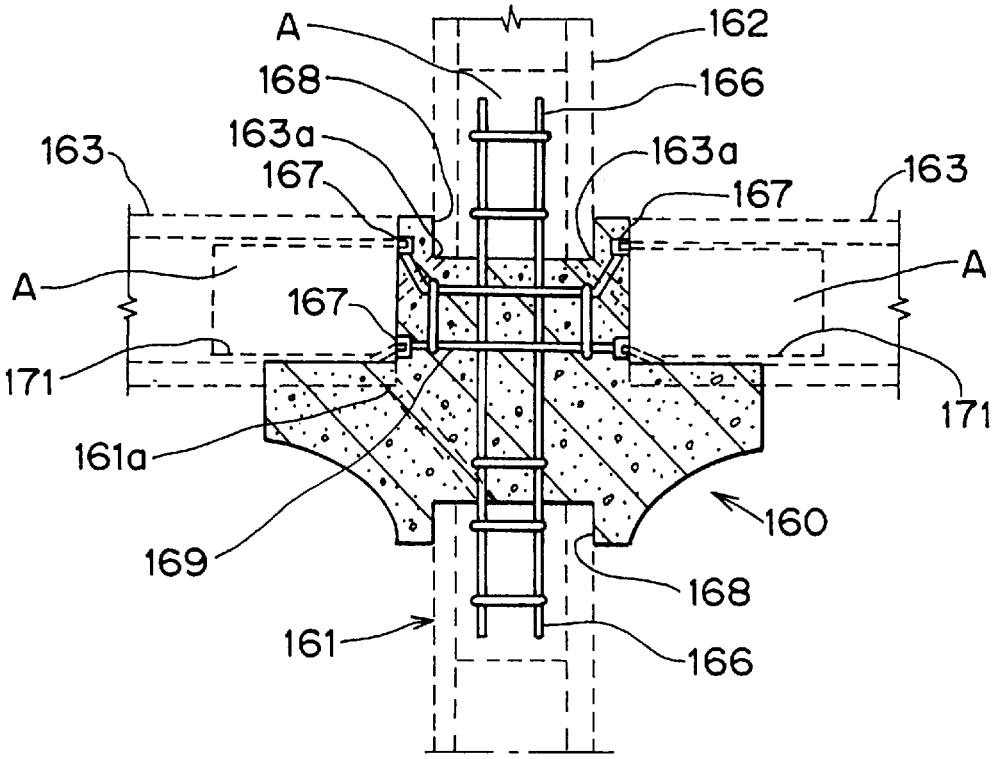
FIG. 41 is a vertical cross-sectional view of the jointing member in FIG. 40(B)

The jointing as shown in FIGS. 40(A) and (B) and FIG. 41 is used for constructing medieval sonorous buildings. FIG. 40(A) is a perspective view of the external appearance of the jointing, FIG. 40(B) is a perspective view of the jointing removing the upper pillar 162 and three beams 163 from that of FIG. 40(A), and FIG. 41 is a vertical cross sectional view of the jointing of FIG. 40(B).

The jointing member 160 is manufactured by concrete, ceramics, iron, nonferrous metals, inorganic or organic fibers such as carbon, aramid which are solidified or manufactured by working a natural stone. The jointing member 160 includes grooves 168 for receiving edge ends of the structure members 161 and 162 comprising an upper and lower pillar at the upper and lower surfaces thereof, and grooves 165 for receiving structure members 163 comprising beams at the side surface thereof depending on the number of the beams. Main pillar rods 166 are embedded in the jointing member 160 in the vertical direction thereof to protrude therefrom, and frame bodies 167 are also embedded in an appropriate manner at the edge end surfaces of main beam rods 169 which are also embedded in the jointing member 160 at the left and right directions thereof.

When the jointing is formed, the grooves 168 of the jointing member 160 are engaged and provided in the upper end of the structure member 161, then the filler is introduced under pressure into the hollow portion of the structure member 161 through the a filling port 161*a* so as to joint both the jointing member 160 and the structure member 161. Successively, structure members 163 of the beams are respectively engaged into respective grooves 165, then the filler A is introduced under pressure into the inside of bag bodies 171 through an introduction port 163*a*, then the filler A is solidified. Finally, structure member 162 of the upper pillar is engaged in the upper grooves 168 of the jointing member 160, and the filler A is introduced to the lower part of the hollow portion of the structure member 162, then the filler A is introduced and solidified to complete the jointing.

Figure 42A:
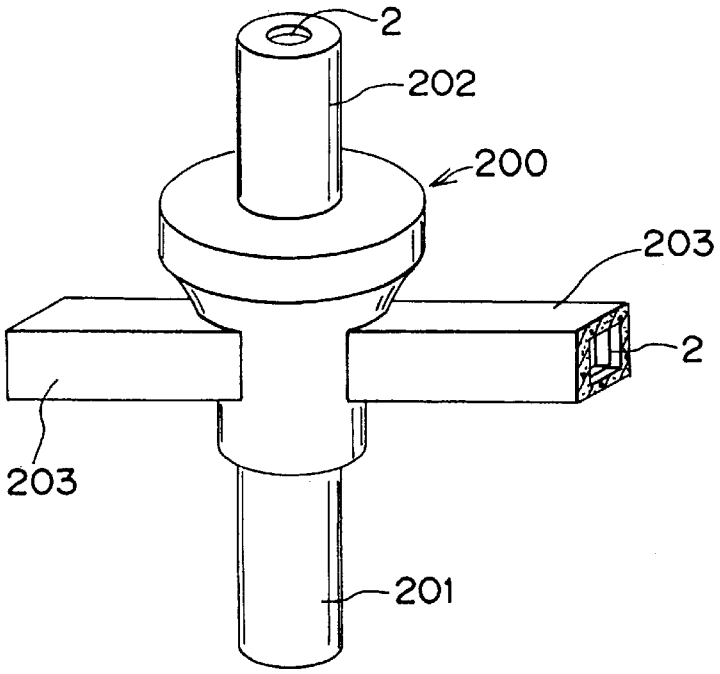
FIGS. 42(A) and (B) are perspective and vertical cross-sectional views showing another example of a jointing member.
Figure 42B:
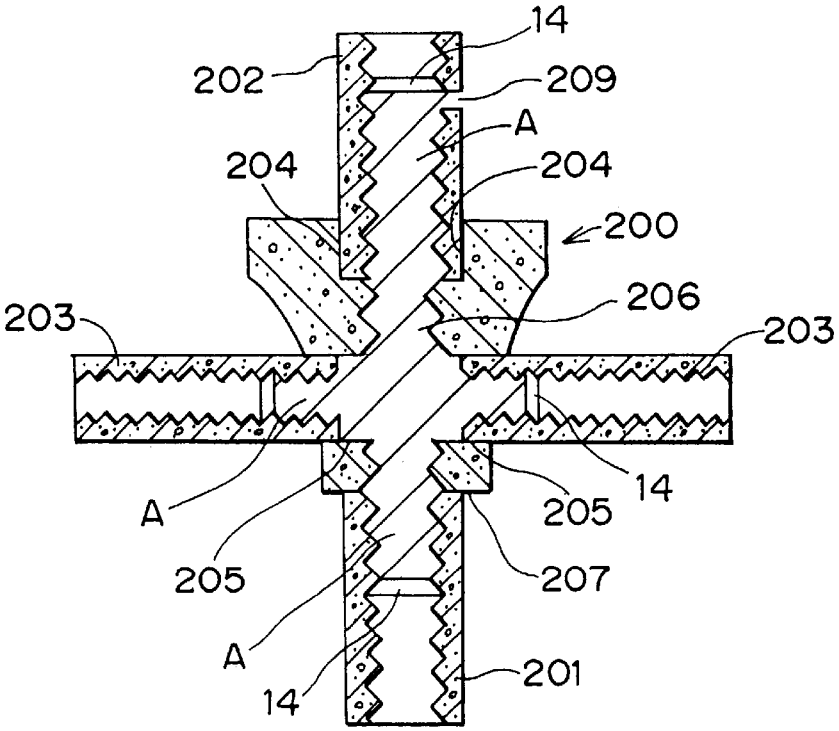

FIGS. 42(A) and (B) show a jointing of a structure member according another jointing block, wherein FIG. 42(A) is a perspective view of the jointing member at the portion adjacent to a jointing member, FIG. 42(B) is a vertical cross-sectional view of the jointing member of FIG. 42(A).

The jointing member in FIG. 40 is solid while a jointing member 200 in FIG. 42 is hollow, but the jointing method of the jointing member 200 in FIG. 42 is similar to that of the jointing member in FIG. 39. A vertical penetrating hole 206 which penetrates vertically the jointing member 200 is defined in the jointing member 200, and irregular portions are provided on the inner surface of the jointing member 200, at need. Lateral holes 205 are defined in the jointing member 200 by the number of the beams, and irregular portions are provided on the inner surfaces of the lateral holes 205 at need, wherein the lateral holes 205 communicate with the vertical penetrating hole 206.

In the method of constructing the jointing members, the jointing member 200 is placed on the lower pillar 201 which is assembled in the aforementioned manner. Although the lower surface of the jointing member 200 contacts upper end surface of the lower pillar 201, it is possible to provide a receiving groove 204 like an upper pillar 202. Then, beams 203 are engaged in the lateral holes 205. Thereafter, the upper pillar 202 is assembled in the receiving groove 204, then the filler is introduced into the receiving groove 204 through a filling port 209. The reinforcing members 166 are embedded or the jointing frame 100, etc. are provided, or the cover members 14, etc. are provided, which are appropriately selected depending on the object of the uses thereof. When the beams are assembled in the jointing, there are utilized the jointing method as illustrated in FIGS. 33 and 39, or the grooves 165 may be disposed in a lateral direction shown in FIG. 40.

Figure 43A:
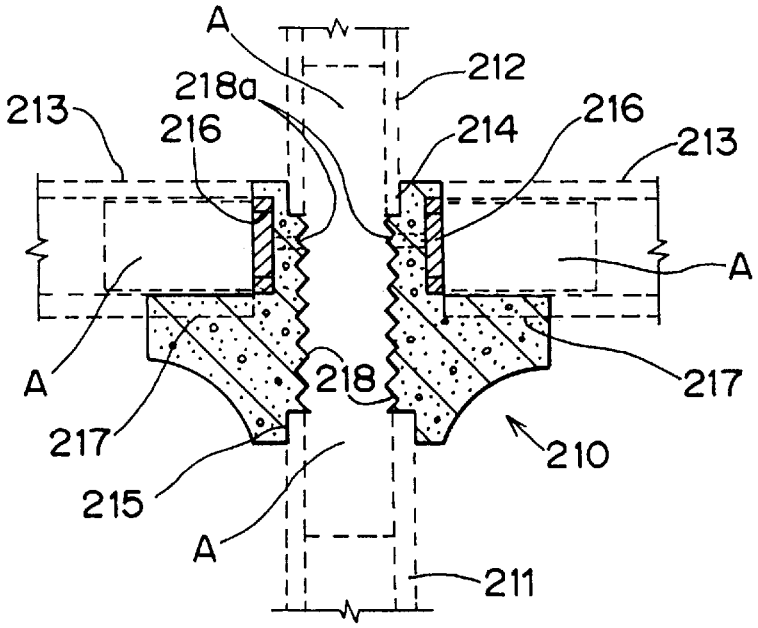
FIGS. 43(A) and (B) are vertical cross-sectional views respectively showing still another example of the jointing member.

The jointing member used by the present invention includes that which is a combination of that in FIGS. 40(A) and (B) and that in FIGS. 42(A) and (B). FIG. 43(A) is a vertical cross-sectional view of such jointing member, and FIG. 43(B) is a vertical cross-sectional view of another jointing member.

A jointing member 210 shown in FIG. 43(A) has a vertically penetrating hole 218 which penetrate the jointing member 210 and also has irregular portions at the center thereof. The pillar head of the lower pillar 211 in engaged in a hole 215 defined in the jointing member 210 in the lower direction thereof, and the former is temporarily fixed to the latter, at need. Jointing frames 216 of the beams are respectively embedded in the jointing member 210, and the receiving grooves 217 are respectively provided like those in FIG. 40. After the beams 213 are provided on the jointing member 210 by the necessary number, a filler is introduced into the jointing member 210 through a filling port 218*a* provided in the vertically penetrating hole 218. Thereafter, the upper pillar 212 is engaged in a hole 214 of the pillar, and a filler is introduced through a filling port of the upper pillar.

Figure 43B:
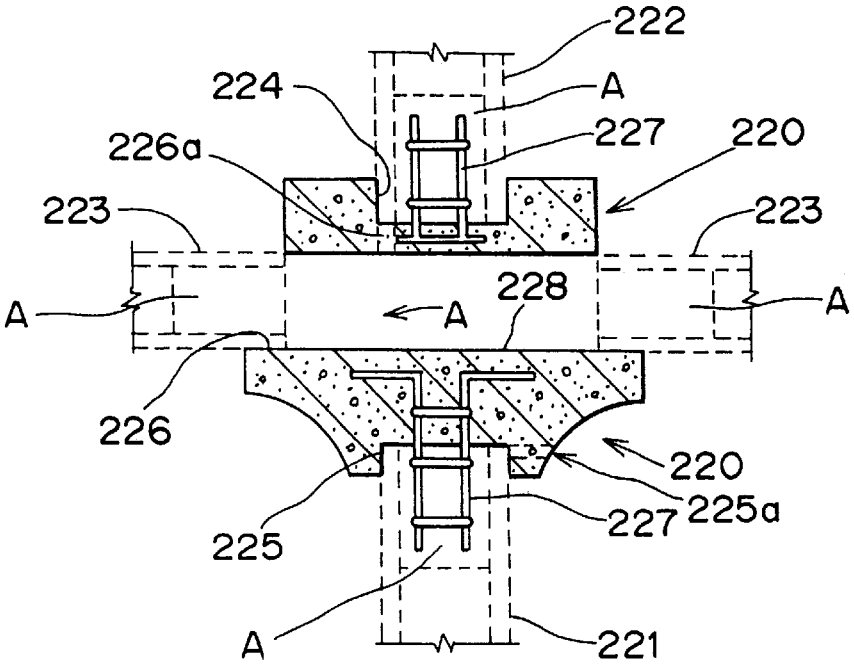

A jointing member 220 in FIG. 43(B) is different from the jointing member 210 in FIG. 43(A) in respect of the provision of a laterally penetrating hole 228. Reinforcing rods 227 are embedded in the jointing member 220 in a vertical direction. A hole 225 of the jointing member 220 is to placed on the pillar head of a lower pillar 221, then a filler is introduced through a filling port 225*a*. Successively beams 223 are respectively provided on a beam placement table 226 of the jointing member 220, and a filler A is introduced through a filling port 226*a* provided in a hole 224 defined in an upper pillar 222. Finally, the upper pillar 222 is provided in the hole 224 of the upper pillar 222, then the filler A is introduced.

Although the kinds of structure members and jointing methods thereof are described in detail with reference various embodiments shown in to FIGS. 1 through 43, the present invention is not limited to these embodiments. Accordingly, it is needless to say that the concrete structure members as set forth above are appropriately combined with one another so as to change the concrete structure thereof in detail within a scope of claims.

For example, if the projecting plates 15*a*, the reinforcing members 15, the jointing frame 100, the notches 15*b* of the pillar in FIG. 39 and the grooves 165 of the beam and the grooves 168 of the pillar in FIG. 40 are respectively inclined, a structure building having the inclined beams and pillars can be constructed.

Since the structure members of the present invention include hollow tubes made of concrete or a material similar thereto, and the irregular portions formed at the inner surface of the hollow tube, if the filler which can be solidifying is introduced while the structure members are butt-joined with each other, so that the structure members can be jointed with each other utilizing the irregular portions. Further, the jointing members can be surely jointed with each other adopting the expansible filler depending on the object of the structure members. Since the working in the site is easy and simple, a worker having no special skill can engage in the work. Still further, it is possible to achieve economical efficiency and enhance diversity of design since the structure members having arbitrary shapes can be used.

When the structure bedding comprising the structure members is completed, the stress is applied to the jointing parts of the structure members. At this time, although stress is generated between edge ends of the irregular portions of the structure members and those of the filler, the inner formwork having the irregular portion at the inner surface of the structure members is embedded, or the reinforcing member is embedded in the jointing part of the structure members, or bag bodies are embedded in the structure members, or fibers of grass, carbon, and aramid are mixed with the filler depending on the degree of the stress applied to the edge ends of the irregular portions. Accordingly, it is possible to coat the surface of the structure member with a surface member or to subject the surface of the structure member to an enforcing treatment. As a result, the present invention can cope with the structure of complex jointing. Further, an ordinary jointing member is used or a sonorous jointing member is used depending on the object of the structures, thereby permitting construction to be simple and also the design to be diversified.

What is claimed is:

1. A hollow structure made of concrete or ceramics and usable as a beam or pillar for use in construction and building structures, wherein said hollow structure has a plurality of structure members, each of said structure members having a hollow inner surface which defines a hollow portion and having irregular portions on the hollow inner surface thereof, each of said structure members having an opening which opens into said hollow portion, one of the structure members and an adjoining one of the structure members being butt-jointed with each other either at adjoining end portions thereof or at an end portion of one of said structure members and a side portion of the adjoining structure member wherein said openings open toward each other, a filler being provided in the hollow portion of each of the structure members wherein said filler extends between said hollow portions through said openings, said filler being a solidified flowable material which fills said hollow interiors and has an outer surface which is defined by said irregular portions, said filler being solidified such that said filler joins the structure members together.

2. The hollow structure according to claim 1 wherein said irregular portions are helical.

3. The hollow structure according to claim 1, wherein an inner formwork is embedded in the hollow inner surface of said hollow structure.

4. The hollow structure according to claim 1, wherein said hollow structure has an attachment portion on an exterior thereof to which an attachment is fixed.

5. The hollow structure according to claim 1, wherein each said structure member comprises a plurality of hollow tubes, said tubes being bundled and integrated with one another.

6. The hollow structure according to claim 1, wherein one said structure member has a notch which opens into said hollow portion along at least a portion of a side thereof.

7. The hollow structure according to claim 1, wherein a reinforcing part is attached to an inner surface of each said structure member.

8. The hollow structure according to claim 1, wherein a surface member is attached to a part or an entire surface of at least one of said structure members.

9. The hollow structure according to claim 1, wherein the irregular portions are continuous to each other.

10. The hollow structure according to claim 1, wherein the irregular portions are discontinuous and cut.

11. The hollow structure according to claim 1, wherein when the structure member and the adjoining structure member are butt-jointed with each other, a filler is introduced into the hollow portion, at least either one of a filling port or a discharge port, or both of a filling port and a discharge port being defined in one of the structure members at the periphery of a butt-jointed portion thereof and permitting the filler to be introduced into the hollow portion.

12. In a support member which defines a beam or pillar arrangement comprising the improvement wherein said support member comprises a plurality of rigid structure members which are rigidly joined together to at least define a beam or a pillar, each of said structure members including an outer wall having an inner surface which defines a hollow interior of said structure member, said inner surface including irregular portions thereon and defining an opening through said outer wall which opens into said hollow interior, each one of said structure members being disposed in butt-jointed engagement with an adjoining one of said structure members wherein said openings of said adjoining structure members are disposed in communication with each other, said support member further including a filler within said hollow interiors of said adjoining structure members wherein said filler extends between said structure members through said respective openings, said filler being a solidified flowable material which fills said hollow interiors and has an outer surface which is defined by said irregular portions, said filler being solidified such that said filler rigidly joins said adjoining structure members together to define a beam or pillar.

13. The support member according to claim 12, wherein said opening opens axially and said irregular portions extend away from said inner surface in a direction transverse to said opening.

14. The support member according to claim 13, wherein said irregular portions are substantially annular.

15. The support member according to claim 12, wherein said support member includes at least one elongate reinforcing member which extends longitudinally into said adjoining hollow interiors, said reinforcing member being embedded within said filler when solidified.

16. The support member according to claim 12, wherein at least one of said hollow interiors of said adjoining structure members includes a removable wall which encloses one side of said hollow interior.

17. The support member according to claim 12, wherein said outer wall of at least one of said adjoining structure members includes a passage into said hollow interior to permit said filler to be introduced into said adjacent hollow interiors.

18. The support member according to claim 12, wherein one of said structure members includes two said openings in communication with said hollow interior, one of said openings being in communication with said one structure member and the other of said openings being in communication with a further one of said structure members such that said filler is disposed within said hollow interiors of said structure members to join said structure members together.

19. The support member according to claim 12, wherein said structure members when joined together by said filler are usable both horizontally and vertically.

20. A method of jointing structure members each comprising a hollow tube made of concrete or a material similar thereto, said hollow tube having a hollow interior defined by an inner surface and having irregular portions on said inner surface, said hollow tube having an opening which opens into said hollow interior, said method comprising butt-jointing end portions or an end portion and a side portion of two or more hollow tubes wherein said respective openings open toward each other, and then introducing a filler into said structure members so as to flow between said hollow tubes through said openings wherein said filler flows about said irregular portions, and solidifying said filler to rigidly loin said hollow tubes together.

* * * * *

UNITED STATES PATENT AND TRADEMARK OFFICE
CERTIFICATE OF CORRECTION

PATENT NO : 6 119 425
DATED : September 19, 2000
INVENTOR(S) : Takeshige SHIMONOHARA

It is certified that error appears in the above-identified patent and that said Letters Patent are hereby corrected as shown below:

On the title page, Item [57]; Abstract line 8; change "arch" to ---each---.

Column 18, line 30; change "loin" to ---join---.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*